United States Patent [19]

Linker, Sr. et al.

[11] Patent Number: 4,764,079

[45] Date of Patent: Aug. 16, 1988

[54] METHOD AND APPARATUS FOR HANDLING DIP DEVICES

[75] Inventors: Frank Linker, Sr.; Frank Linker, Jr., both of Broomall; Edward T. Claffey, Aston, all of Pa.

[73] Assignee: American Tech Manufacturing, Inc., Glenolden, Pa.

[21] Appl. No.: 879,611

[22] Filed: Jun. 27, 1986

[51] Int. Cl.[4] ..... B65B 69/00

[52] U.S. Cl. ..... 414/411; 414/418; 414/425

[58] Field of Search ..... 198/465.1, 803.01, 624; 414/404, 411, 418, 425, 403

[56] References Cited

U.S. PATENT DOCUMENTS

| | | | |
|---|---|---|---|
| 3,379,140 | 4/1968 | Crispe et al. | 198/624 X |
| 3,880,205 | 4/1975 | Linker et al. . | |
| 4,067,370 | 1/1978 | Chang | 198/624 X |
| 4,222,166 | 9/1980 | Kurek et al. | 414/404 X |
| 4,228,864 | 10/1980 | Berger et al. | 414/411 X |
| 4,481,984 | 11/1984 | Linker . | |
| 4,618,305 | 10/1986 | Cedrone et al. | 414/403 |
| 4,640,409 | 2/1987 | Holtman | 198/624 |
| 4,647,269 | 3/1987 | Wedel et al. | 414/403 X |
| 4,648,773 | 3/1987 | Bieganski | 414/411 |
| 4,660,710 | 4/1987 | Swapp et al. | 414/403 X |
| 4,686,637 | 8/1987 | Linker, Jr. et al. . | |

*Primary Examiner*—Peter A. Aschenbrenner
*Assistant Examiner*—James R. Brittain
*Attorney, Agent, or Firm*—Eugene E. Renz, Jr.

[57] ABSTRACT

A system for handling DIP devices packaged in elongated tubes having releasable closure means normally closing at least one end of the tubes to retain DIP devices therein, a head assembly for transferring tubes from an accumulator station to a DIP processing apparatus comprising a housing having an inlet and a discharge trackway section, a pair of drive rollers rotatably mounted adjacent the inlet end of the housing. The rollers are mounted for floating movement relative to one another in a direction generally transverse to the movement of tubes through the housing, closure removal and re-application mechanism downstream of the drive rollers, means for aligning the tube to ensure flow of DIP devices from the tube to the discharge trackway and tube position sensor means operable to activate mechanism for positioning the head assembly so that the discharge trackway section aligns with an inlet trackway of DIP processing apparatus.

20 Claims, 18 Drawing Sheets

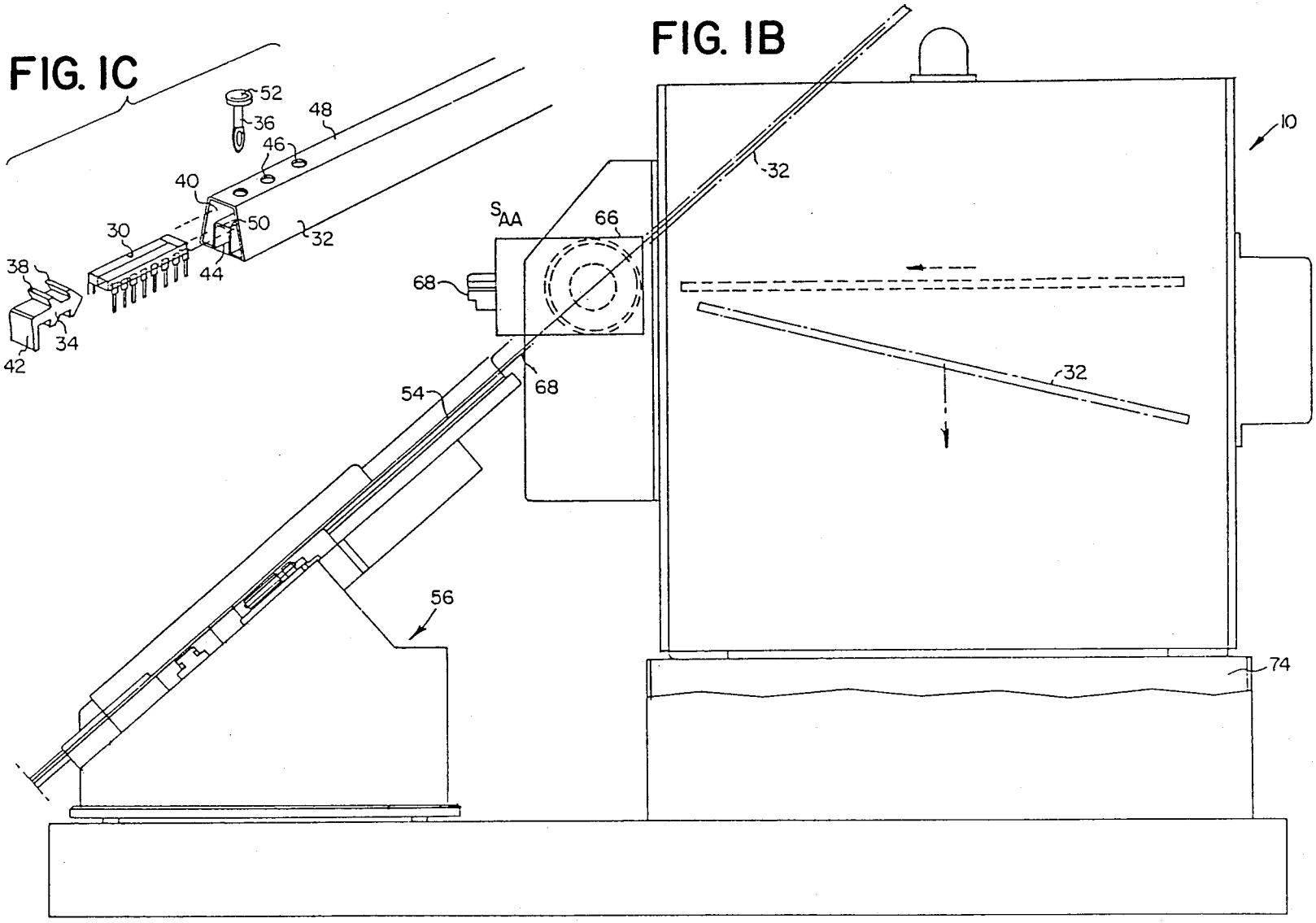
FIG. IB
FIG. IC

METHOD AND APPARATUS FOR HANDLING DIP DEVICES

FIELD OF THE INVENTION

The present invention relates broadly to new and improved method and apparatus for handling DIP devices and more specifically to a novel head assembly for use in transferring DIP devices packaged in tubes.

DIP devices are typically comprised of an elongated generally rectangular body portion made of moldable material and having imbedded therein a plurality of leads arranged in rows depending from opposite side edges of the body portion and disposed at a predetermined angular relation thereto. During manufacture, or during assembly onto printed circuit boards (hereafter "PCB"), groups of DIP devices are placed into plastic storage tubes for ease in handling and to prevent damage. Each group generally includes ten (10) or more DIP devices. By plugging the open ends of each tube, the DIP devices are contained until required. The present invention relates to the insertion or removal of such groups of DIP devices to or from such delivery tubes.

BACKGROUND OF THE INVENTION

As is well known in the art, DIP devices consisting of a body portion, and attached and depending leads connected thereto for assembly onto a PCB or the like, are manufactured with the leads disposed in a particular arrangement adapted for insertion in the predetermined array or pattern of holes or sockets in a PCB. The material of the leads and their connection to, and disposition on, the DIP bodies frequently results in a bending or distortion of the leads due to handling during manufacturing operations. By placing DIP devices in plastic delivery tubes some protection is provided. However, such protection is limited.

As a result of the continued bending and distortion, a series of apparatus and methods have been developed to straighten or reorient DIP devices or to determine DIP leads integrity in order to evaluate whether a straightening operation is required. Examples of such DIP lead straightening apparatus and methods are disclosed in U.S. Pat. No. 3,880,205 for ELECTRONIC COMPONENT LEAD STRAIGHTENING DEVICE AND METHOD, and U.S. Pat. No. 4,481,984 for ELECTRONIC COMPONENT LEAD STRAIGHTENING DEVICE AND METHOD both owned by the Assignee of the instant application. Examples of such integrity determination apparatus and methods are disclosed in U.S. patent application Ser. No. 648,872, Pat. No. 4,686,637, for APPARATUS AND METHOD FOR LEAD INTEGRITY DETERMINATION FOR DIP DEVICES, filed Sept. 10, 1984, and U.S. patent application Ser. No. 735,857, now Pat. No. 4,704,700, for IMPROVED APPARATUS AND METHOD FOR LEAD INTEGRITY DETERMINATION FOR DIP DEVICES, filed May 20, 1984, both of which are ownedy by the Assignee of the instant invention.

In the past the delivery tubes were presented to such and similar apparatus by manually removing a pin or a plug from the end of each tube and thereafter manually inserting each tube in a receptacle attached to the apparatus. A typical DIP straightening apparatus included a turret arrangement of the type disclosed in the U.S. Pat. No. 4,481,984. Additionally, it was known to manually pre-orient DIP tubes by inserting a number of tubes into a magazine rack-type device. Such magazine rack-type devices typically only held 6 to 60 tubes at a time. Such manual operation was not only time consuming but also increased the possibility of further damage to the DIP devices.

Automatic handling of DIP tubes is illustrated in a pending application Ser. No. 807,531 for A METHOD AND APPARATUS FOR LOADING/UNLOADING DIP DEVICES, filed Dec. 11, 1985 and assigned to the common Assignee of the present application. This pending application is incorporated herein by reference in its entirety. In accordance with the method and apparatus disclosed therein, a plurality of DIP tubes can be placed into a hopper at random orientation. Orienting components, provided in the present invention, remove individual tubes from the hopper and orient the tubes to a predetermined radial orientation. In response to a control signal, the oriented delivery tube is moved axially in a direction for insertion into a head assembly. The head assembly receives the delivery tube from the orienting components and guides the tube to a predetermined axial orientation. After the transfer of DIP devices, the tube is ejected from the head assembly. A control member is also provided in the present invention to coordinate the movement of the orienting components and the head assembly. Such coordination is achieved through the generation of control signals, which signals cause the orienting components and head assembly to operate in predetermined controlled sequences.

The present invention is directed to novel improvements in the head assembly providing a number of functional advantages. For example, the particular configuration and arrangement of the head assembly facilitates easy and quick interchangeability of parts of the mechanism to remove plugs and pins from the tubes and reassembly thereof during loading and unloading operations.

Still another feature of the head assembly of the present invention is the dual drive system for actuating tubes during the loading and unloading cycle which provides a more positive controlled driving action and minimizes slippage.

Still another feature of the head assembly of the present invention is the provision of means for pulsing or agitating the tubes during the unloading or loading cycle to ensure complete emptying or filling thereof.

In accordance with another feature of the present invention, the head assembly includes a novel duck-bill linkage arrangement for centering the tubes relative to the discharge trackway thereof and a singulating wheel for unloading the DIP devices which minimize hang-up and ensures proper spacing during movement thereof to the next station in the system.

In accordance with another feature of the present invention, a rake assembly is provided which in tandem systems of the type illustrated in FIG. 1 provides a means for correcting DIP jamming adjacent the lower unit.

BRIEF DESCRIPTION OF THE DRAWINGS

These and other objects of the present invention and the various features and details of the operation and construction thereof are hereinafter more fully set forth with reference to the accompanying drawings, wherein.

DETAILED DESCRIPTION OF THE PREFERRED EMBODIMENT

The present invention is directed primarily to improvements in the head assembly. However, there are features to the entire system that are also new and comprise improvements over the pending application Ser. No. 807,531, above identified, which is incorporated herein in its entirety by reference. Portions of the loader system which are generally the same as that disclosed in the pending application Ser. No. 807,531 are described hereinafter for better understanding of the head assembly and the other features of the present invention.

Figure 4:
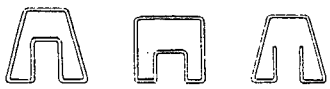
FIG. 4 PRIOR ART
FIG. 4 is end elevational views of cartridges showing various cross-sectional configuration of conventional cartridges or tubes for DIP devices.
Figure 6:
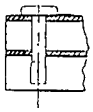
FIG. 6 is a fragmentary view showing a pin in place in a cartridge.
Figure 5:
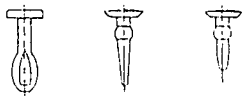
FIG. 5 PRIOR ART
FIG. 5 illustrates conventional pins utilized in the ends of the cartridges to retain the DIP devices therein.
Figure 7:
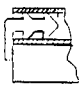
FIG. 7 shows a plug sealing device for a cartridge.

The system and apparatus of the present invention are adapted for loading or unloading DIP devices, i.e. the transfer of DIP devices to or from elongated tubes T. FIG. 4 shows typical cross-section of elongated plastic tubes T used for storing DIP devices. FIGS. 5, 6 and 7 show typical pins P or plugs $P_L$ utilized in the ends of the tubes for normally retaining the DIP devices within the tubes. Of course, these plugs or pins must be removed to permit exit of DIP devices from the tubes and the present invention provides a means for doing this by automatic handling equipment.

DIP devices which typically have a plurality of leads embedded into a generally rectangular body portion are housed in the tubes to provide ease of handling and prevent damage especially to the leads. Each outer end of the tube is sealed with either a pin P of the type illustrated in FIGS. 5 or 6 or a plug $P_L$ of the type illustrated in FIG. 7. Note that the plug $P_L$ has a series of projections which snugly embrace the opening in the tube and a finger tab F to permit grasping the plug for removal purposes.

The present invention can be operated to manipulate either tubes filled with DIP devices to transfer single DIP devices on the trackway of a further apparatus for operation thereon or the presentation of empty cartridges to the discharge trackway of such further apparatus for receipt of DIP devices and to remove the tube when full.

The method of the present invention will be presented hereinafter in conjunction with the description in its capacity for loading DIP devices on to the trackway of separate DIP device testing or handling apparatus.

Figure 2:
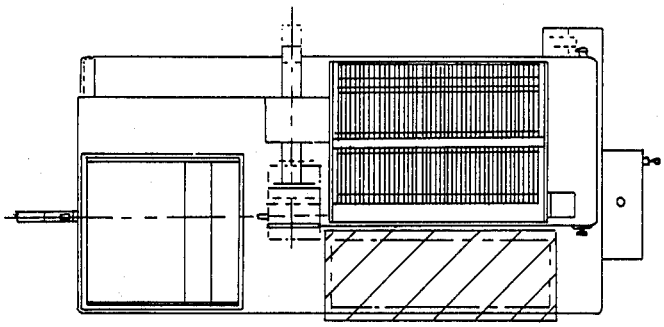
FIG. 2 is a top plan view of the system illustrated in FIG. 1.
Figure 1A:
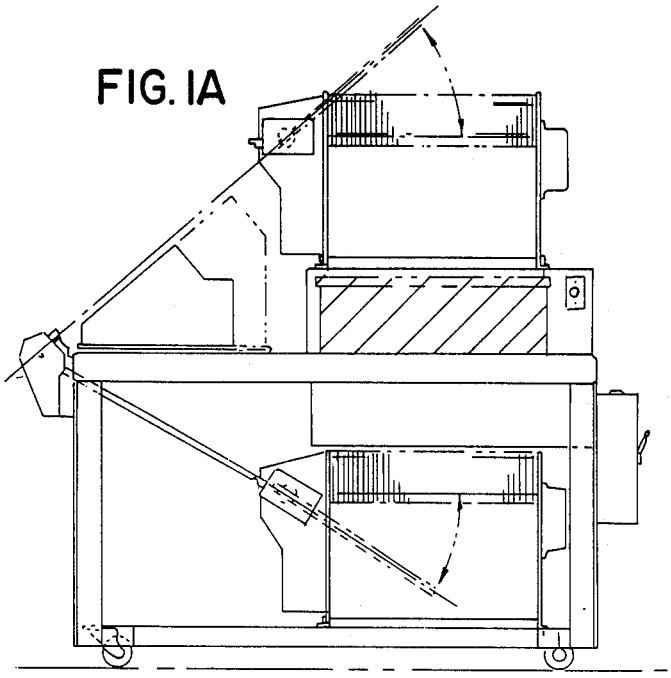
FIG. 1*a* is a side elevational view illustrating a DIP device handling system in accordance with the present invention which incorporates a novel head assembly as part thereof.
Figure 3:
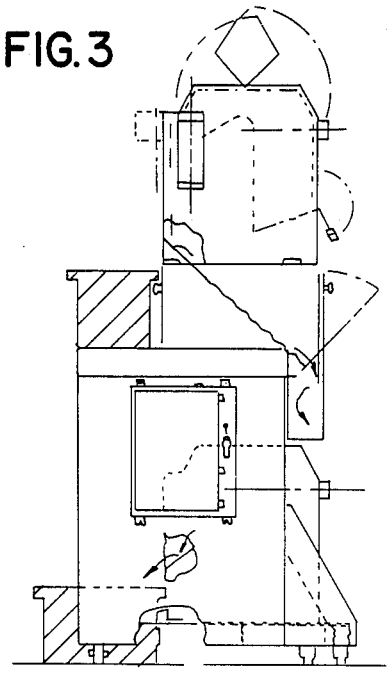
FIG. 3 is an end elevational view showing the overall system.
Figures 1, 29A:
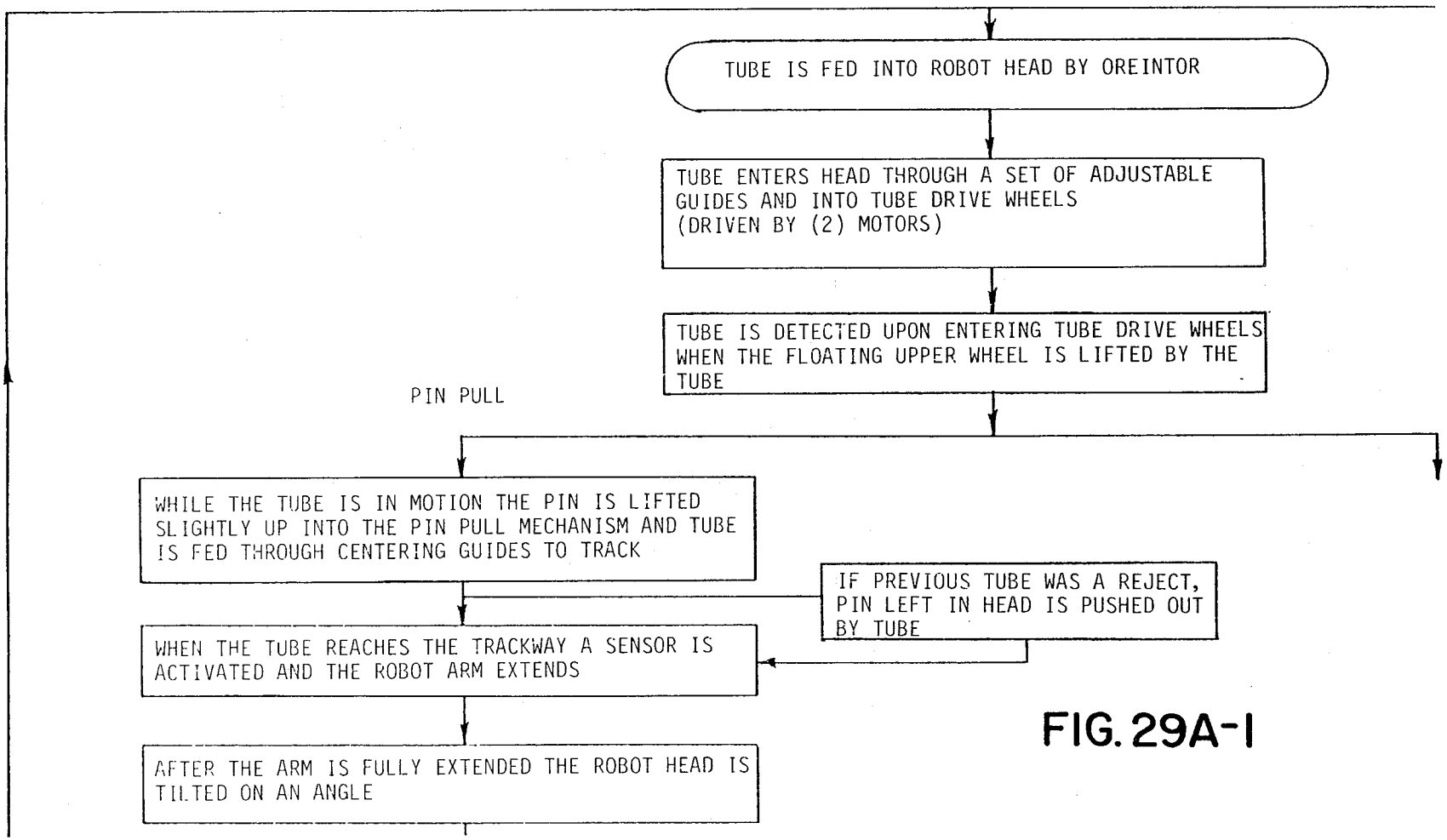
FIG. 1*b* is a side elevational view of a loader and DIP handling apparatus in accordance with the present invention.
FIG. 1*c* is a perspective view of a tube, DIP device and plug.
FIG. 29 is a flow chart showing the various operations of the orientor head.
Figures 2, 29A:
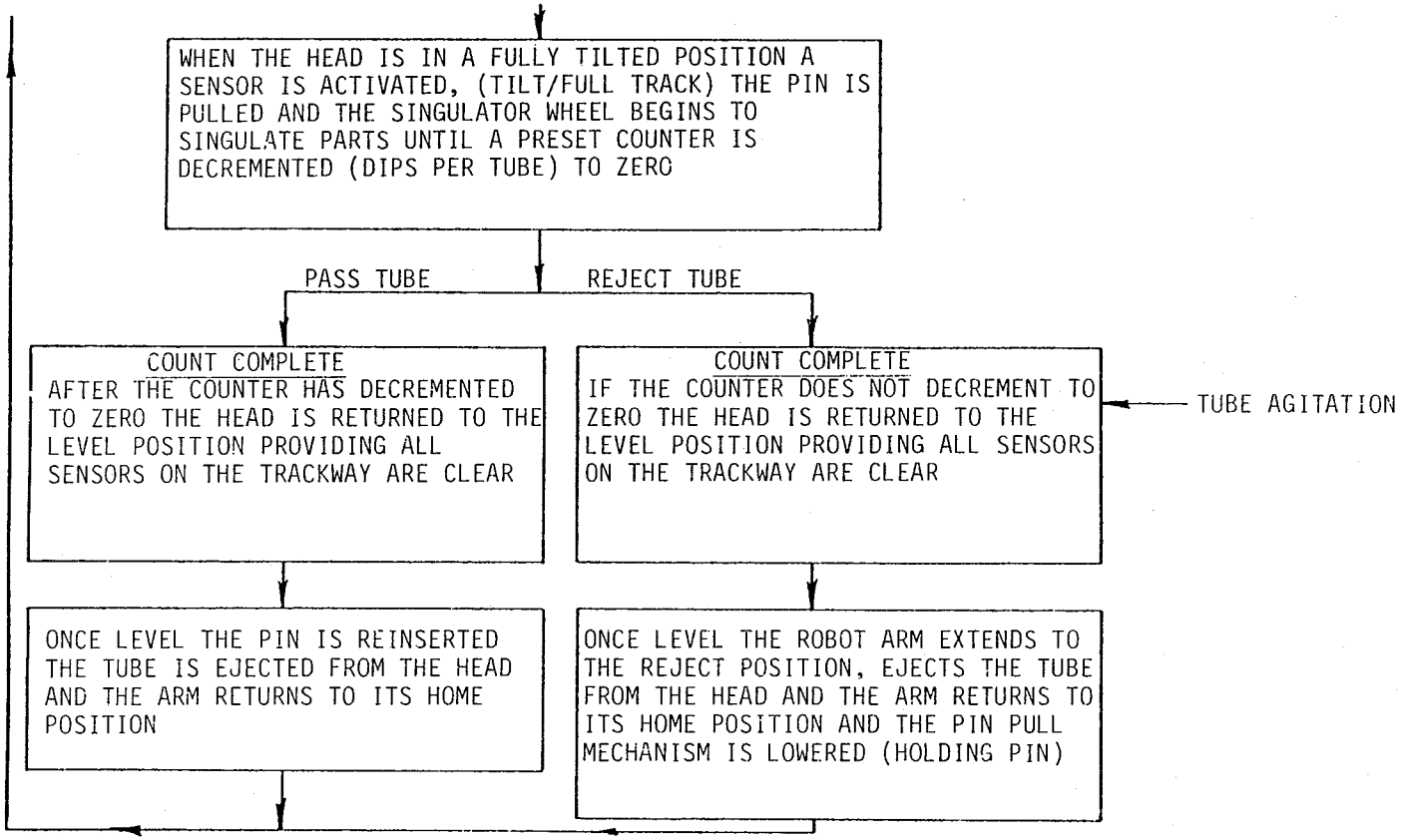
Figures 1, 29B:
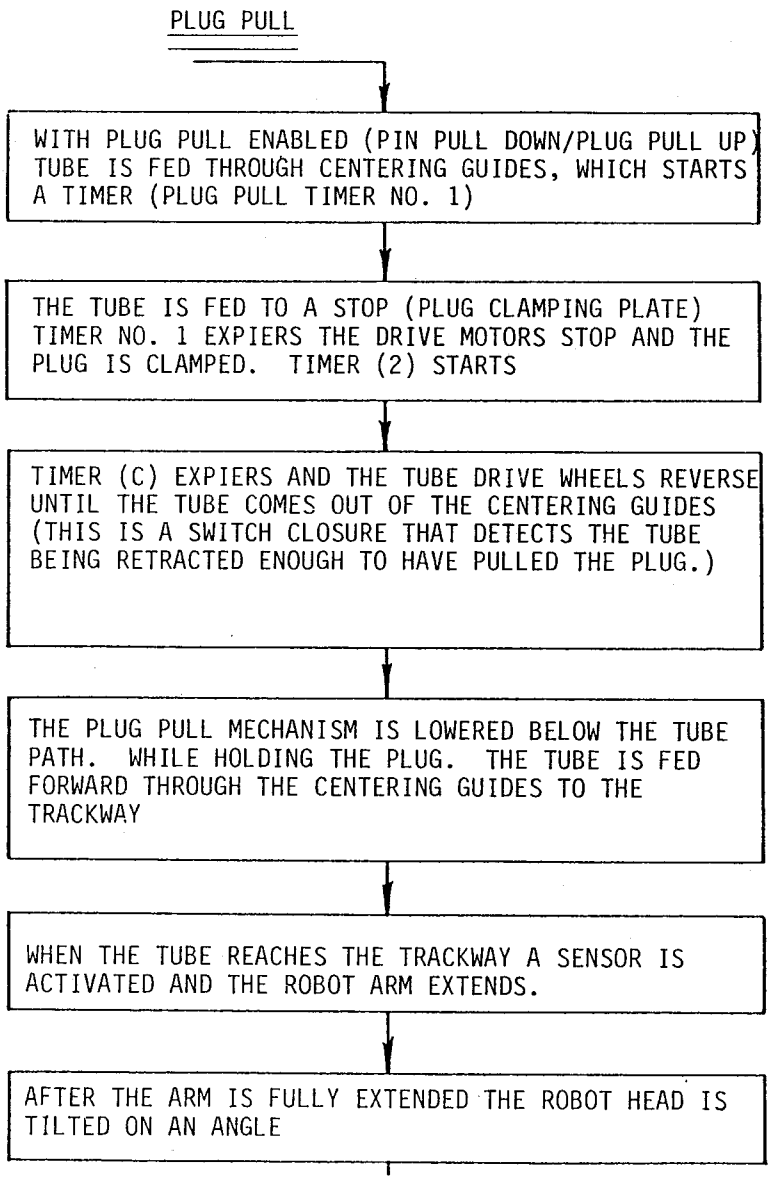
Figures 2, 29B:
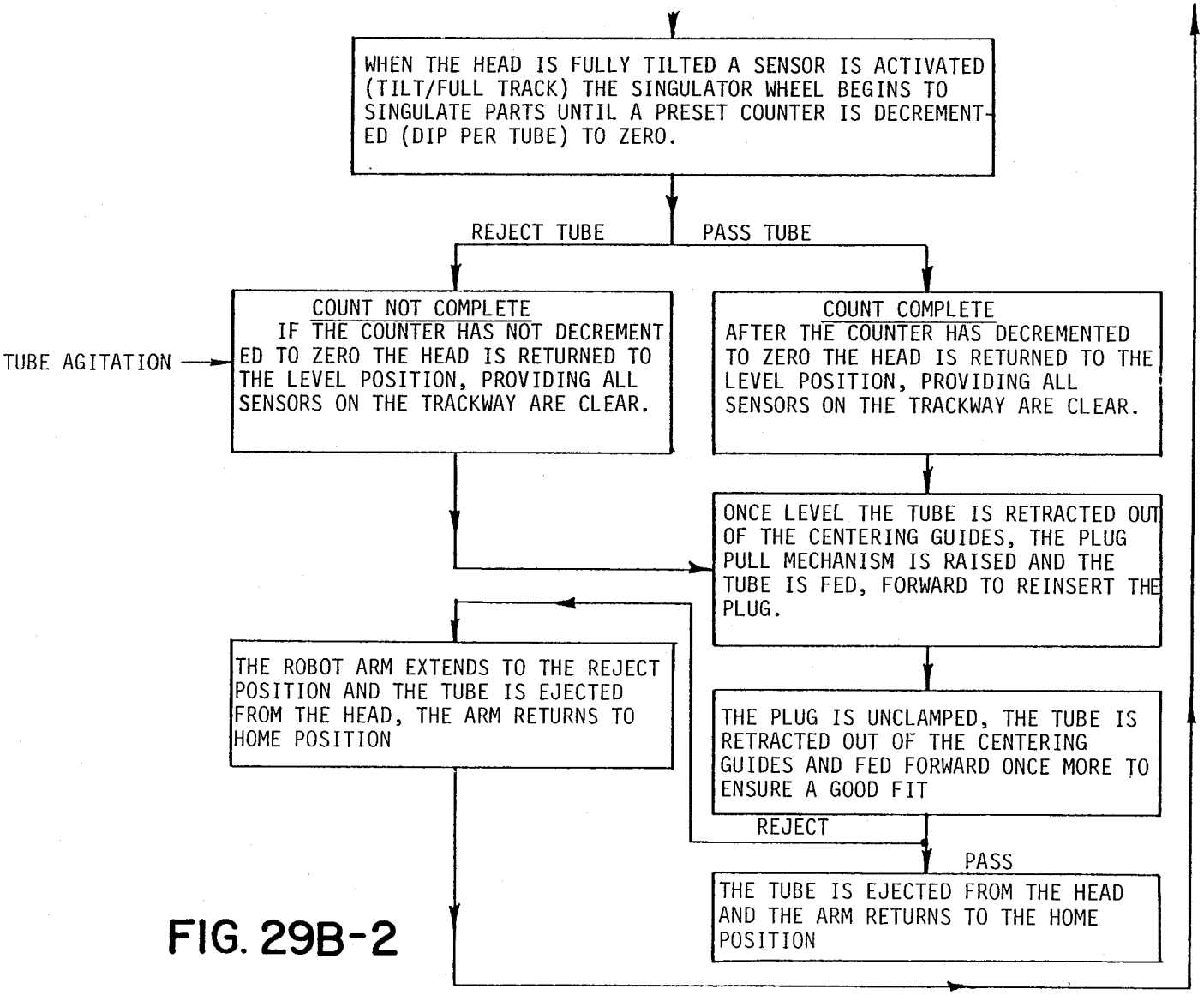
Figure 30:
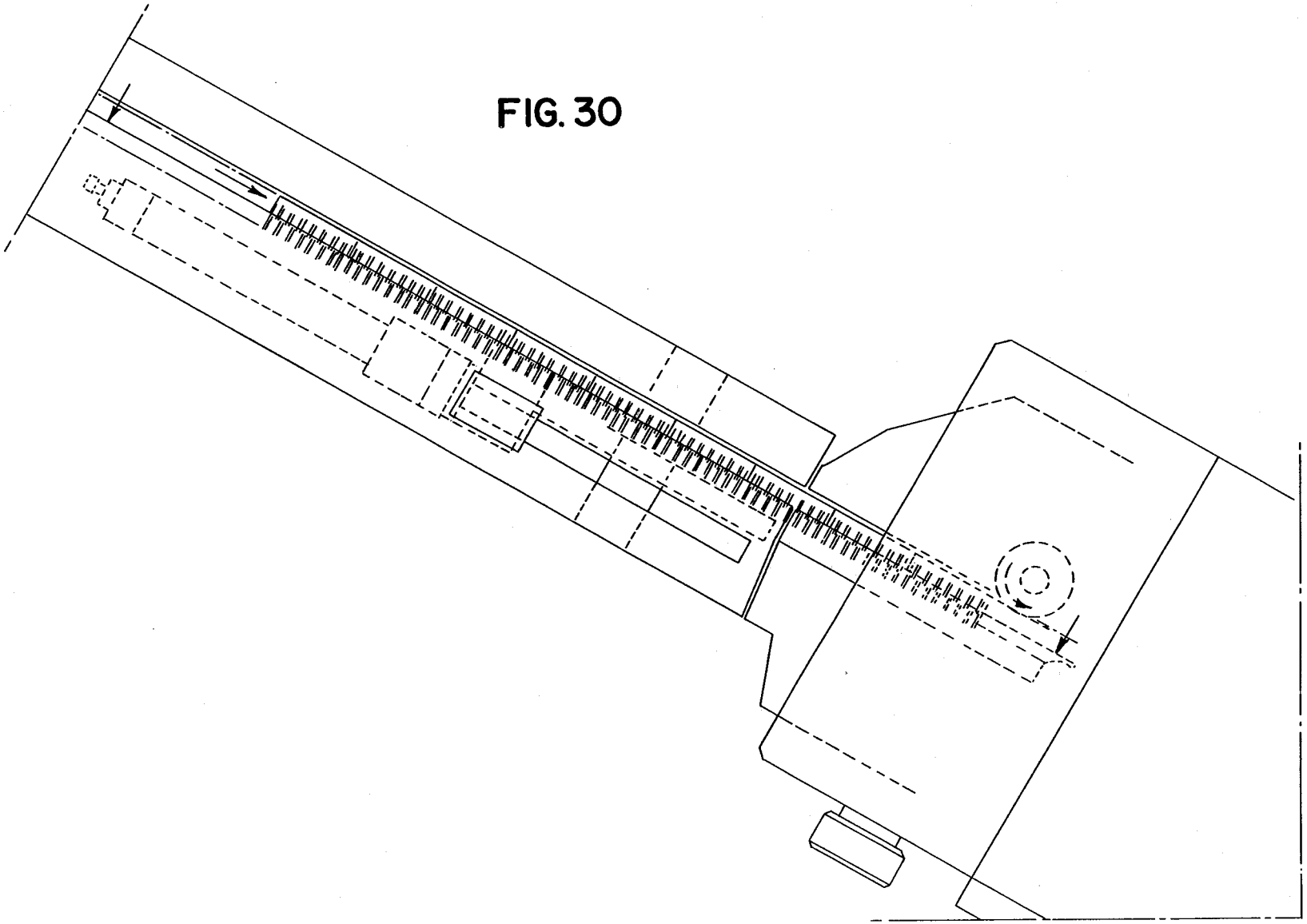
FIG. 30 is a side elevational view of a DIP jam correcting mechanism and is in accordance with the present invention with parts broken away to show the internal portions of the mechanism.
Figure 31:
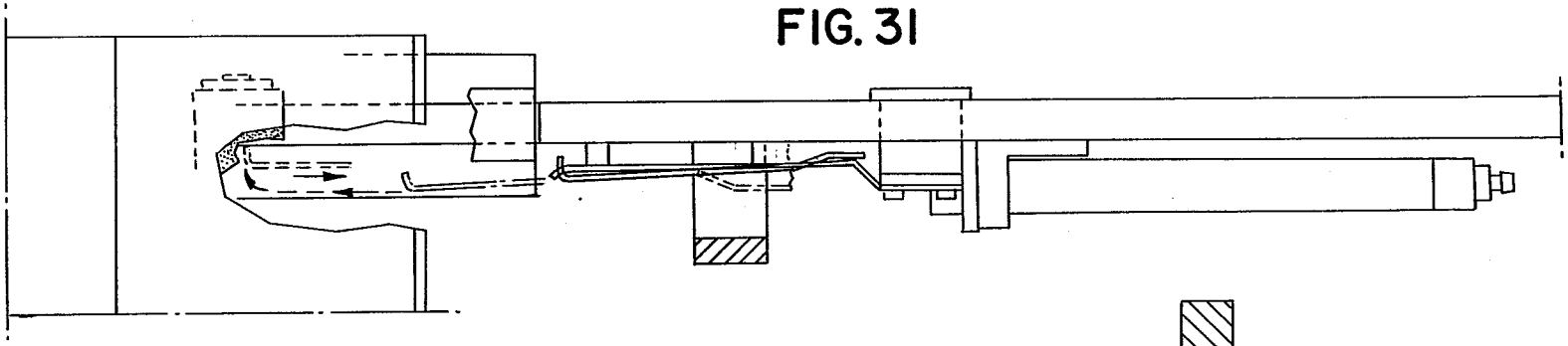
FIG. 31 is a top plan view thereof showing the rake arm in various operative positions.
Figure 33:
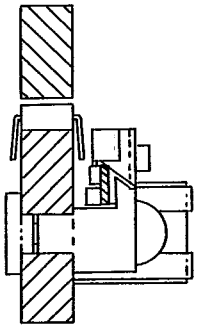
FIG. 33 is a fragmentary side elevational view showing the portion of the lower track section and lower DIP handling apparatus and the DIP jam-correcting mechanism of the present invention.

FIGS. 1-3 inclusive illustrate a typical DIP device handling system incorporating method and apparatus in accordance with the present invention. The system includes a pair of upper and lower substantially identical loading mechanisms as described in more detail below. The upper loading mechanism is adapted to take tubes filled with DIP devices and present them for feeding through a processing apparatus such as scanning or lead straightening device and then through an indexing mechanism $I_M$ which directs the scanned or straightened DIP devices to a lower accumulating station wherein the DIP devices are again housed in tubes. As illustrated, the tandem arrangement includes tote boxes for accumulating tubes at various locations in the system. For example, the upper totle box $B_1$ may be used for storing tubes after they are emptied and the lower tote box $B_2$ for tubes filled with processed DIP devices.

The conveyor-type loaders of each system may be interconnected by passages and the like to direct tubes emptied at the upper station down to the conveyor of the lower station to be utilized in repackaging the processed DIP devices. The path of tube flow in the system is indicated by flow arrows. (See FIG. 3)

Figure 8:
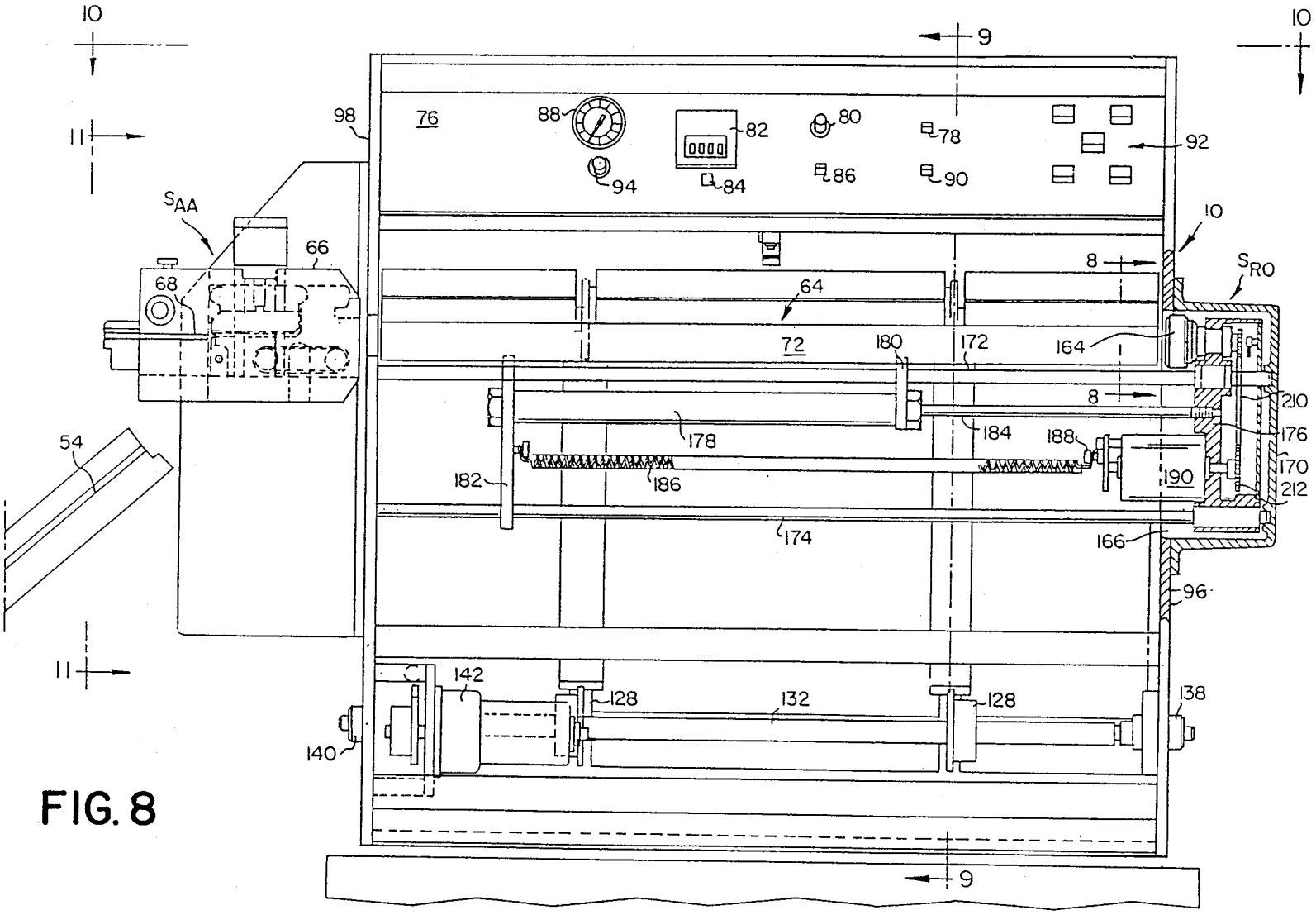
FIG. 8 is a side elevational view of the upper orientor station partly in section and instrument control panel.
Figure 9:
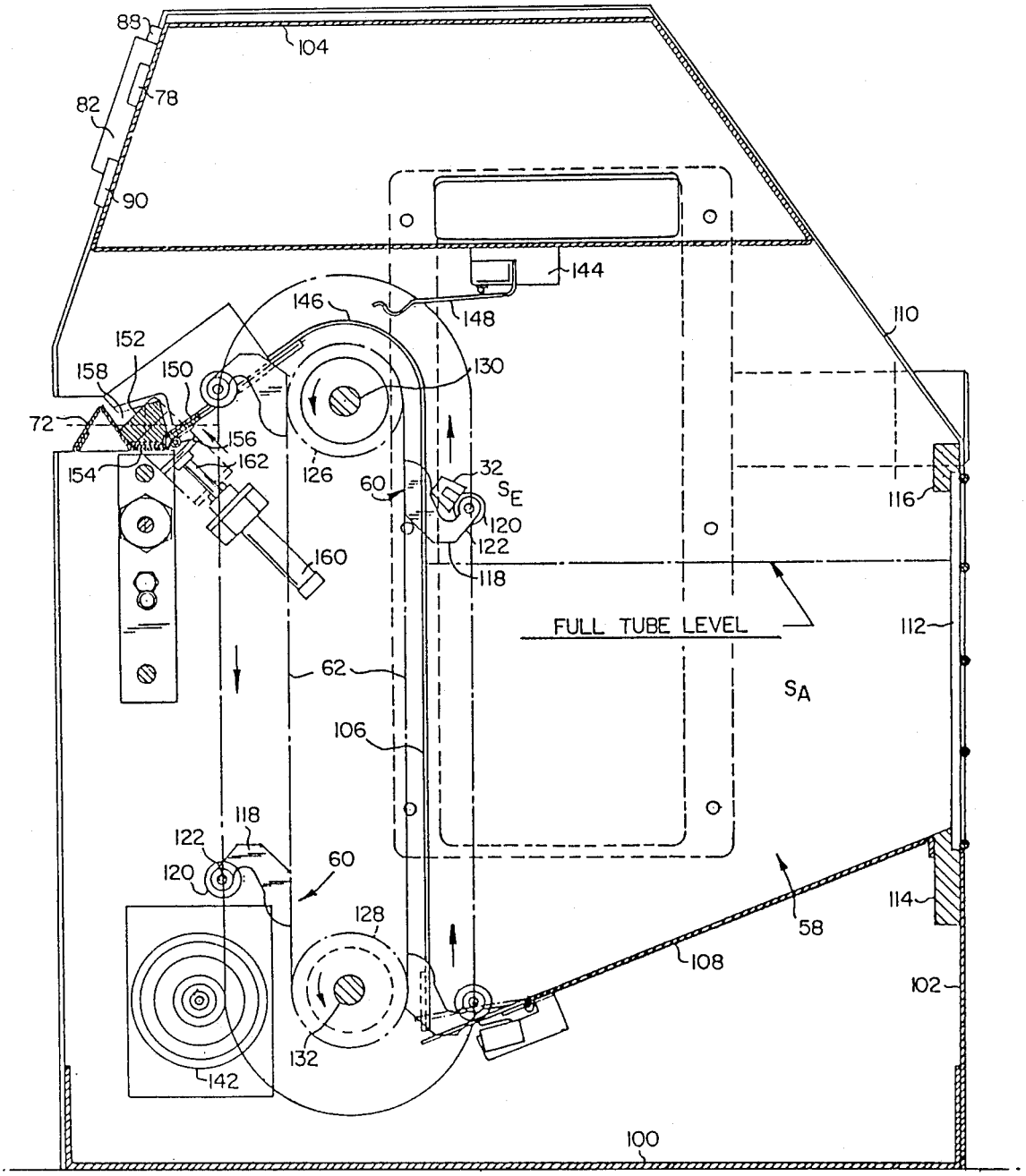
FIG. 9 is an enlarged transverse sectional view taken on lines 9—9 of FIG. 8.
Figure 10:
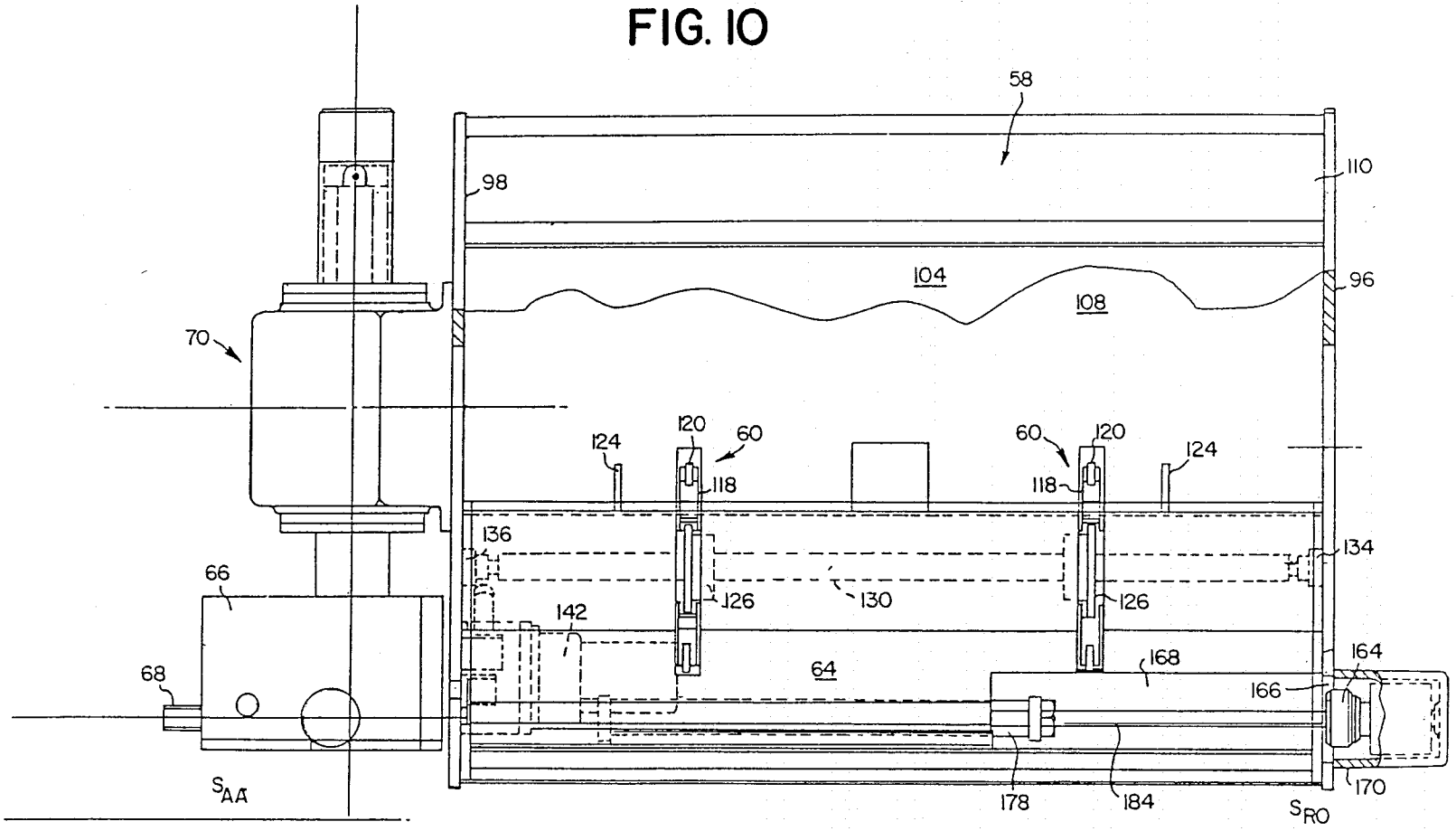
FIG. 10 is a plan view taken on lines 10—10 of FIG. 8 with a portion of the top broken away to show additional details in greater clarity.

A general understanding of the basic structure and operation of the apparatus of the present invention may be gained by several of the views which best show the basic components of the apparatus and operation thereof such as FIGS. 8–10. Considering first the basic components of the loading apparatus in terms of interrelated functions, the apparatus generally designated 10 as shown in FIG. 9 includes an accumulator station or hopper $s_A$, an elevator station $S_E$ which removes one tube at a time from the accumulator station and presents such tube to radial orientation station $S_{RO}$. In the orientor station, the delivery tube is given a predetermined radial orientation. Located adjacent orientor station $S_{RO}$ is the axial alignment stations $S_{AA}$, where the delivery tube is inclined to a predetermined axial orientation. As shown in FIG. 8, such predetermined axial orientation results in the alignment of tube 32 with trackway 54 of the integrity determination and straightening apparatus generally designated 56.

Tracing now briefly a typical cycle of operation, tubes 32 filled with DIP devices and sealed at both ends with either pins 36 or plugs 34 are manually loaded into hopper 58, shown in FIG. 9. The cartridges as loaded are arranged in a longitudinal cluster. Information is entered into a computer control member which coordinates the movements and interrelationship of the various stations described herein. Such information includes specifying the number of DIP devices per tube, the number of leads per DIP device and whether the cartridge is sealed at both ends with pins or plugs.

As shown in FIGS. 9 and 10, several pairs of hooks 60 are attached to conveyor chain 62 (shown as a dot-and-dashed line in FIG. 9). These major components of elevator station $S_E$ operate to convey a single cartridge from hopper 58 to the trough 64 of radial orientation station $S_{RO}$. Within the orientation station the orientation assembly engages one end of the tube 32 and adjusts the rotational alignment, i.e. radial orientation, of the tube. The orientor assembly pushes the free end portion of the length of now radially aligned tube 32 into axial alignment station $S_{AA}$. Upon entry of the pre-sealed tube, the alignment assembly 66 removes the pin or plug from the tube end. Having removed pin 36 or plug 34, the open end of tube 32 abuts one end of an inner trackway 68 which has a length about half that of alignment assembly 66.

Alignment assembly 66, having grasped tube 32, is traversed by arm 70 to a second position wherein tube 32 is moved generally horizontally to a position outside trough 64. As it moves forward, tube 32 deflects pivotally attached trough sidewall 72. When in such second position, inner trackway 68 of alignment assembly 66 should then lie in the same plane with trackway 54 of the separate DIP-testing device 56.

Alignment assembly 66 is rotated by arm 70 counterclockwise to an angle of about 40, from horizontal forcing the exposed length of tube 32 upwards. After rotation of alignment assembly 66, the outermost end of inner trackway 68 engages trackway 54 of separate DIP testing device 56.

DIP devices are gravity fed onto inner trackway 68 and initially encounter a singulator system $S_s$ (shown and described in greater detail in connection with FIG. 19) wherein hold-down and detent means function to release DIP devices one at a time so that only a single DIP device will travel on trackway 54 at any one time.

Once all DIP devices have been transferred from tube 32, either the pin-pull mechanism re-inserts pin P into the tube or plug $P_L$ is re-inserted. Once an empty tube is closed, alignment assembly 66 ejects that tube. Since alignment assembly is still in the second position, a bin 74 appropriately placed at the foot of loading apparatus 10 catches and accumulates ejected tubes. After tube ejection, the alignment assembly returns to a "home" position wherein it is aligned to receive the next tube present in orientation station $S_{RO}$.

Suitable controls, including circuitry to be described in more detail hereafter, are provided in computer control member for effecting operation of the loading apparatus in the manner broadly described above. As shown in FIG. 8, a control panel 76 is mounted on the face of apparatus 10 within easy view of the operator and includes the various automatic and manual operating controls for the electronic and pneumatic control systems. These include poewr-on switch 78 which activates the computer control member, multi-position dial switch 80 for setting the known number of leads per DIP device which in the preferred embodiment includes three positions representing 8, 28 and 48 leads respectively, counter mechanism 82 for setting the known number of DIP devices per tube, reset button 84 for resetting counter mechanism 82, switch 86 for setting pin or plug pull, air pressure gauge 88 for measuring the air pressure in the pneumatic system, cycle start switch 90 for manually staring or stopping an operating cycle, a series of fuses 92 and an indication light 94 for indicating when orientor station $S_{RO}$ is feeding a tube into alignment assembly 66, all of which will be described in further detail herein.

Turning now to a more detailed description of the components generally described above, FIGS. 8, 9 and 10 show apparatus 10 to include a housing broadly defined by side walls 96 and 98, base 100, front wall 102 and top 104. Top 104 serves to house the computer control member. Within the confines of this housing is hopper 58 which is further defined by real wall 106 and bottom wall 108. As shown in FIG. 3, wall 108 is inclined so that tubes placed in hopper 58 through opening 110 will fall to the joint where walls 106 and 108 meet. In the preferred embodiment, front wall 102 is provided with a transparent section 112 to enable a user to determine whether hopper 58 is empty. Section 112 is attached to front wall 102 by mounting brackets 114 and 116 which are secured to either front wall 102 or side walls 96 and 98 by any suitable means.

Tubes 32 are removed from hopper 58 by the elevator station $S_E$. As previously described, the elevator station $S_E$ includes pairs of hooks 60 attached to a conveyor chain 62. As shown in FIGS. 9 and 10, each hook 60 includes a hook-shaped body member 118 having one end attached to chain 62 and having roller 120 rotatably mounted to the other end by pin 122. The body member/roller assembly is sized to only accept one tube 32. If more than one tube is removed by a pair of hooks 60, spring projections 124 serve to knock the excess tubes back into hopper 58.

Chain 62 is mounted on toothed gears 126 and 128, which in turn are mounted on shafts 130 and 132, respectively. As will be appreicated from FIGS. 8 and 10, a pair of chains 62 and associated toothed gears are provided so that a tube 32 may be elevated from hopper 58 in a generally horizontal orientation between a pair of hooks 60. Shafts 130 and 132 are rotatably mounted between side walls 96 and 98 by means of bearings 134,136 and 138,140, respectively. Rotation is provided to shaft 132 by elevator motor 142 through a suitable gear arrangement. Thus, activation of elevator motor 142 by the computer control members results in the removal of a tube 32 from hopper 58.

To ensure that only one tube 32 is in orientor station $S_{RO}$ at a time, a switch 144 is provided. Switch 144 is attached above the top curved segment 146 of rear wall 106. Switch 144 is provided with an arm 148 which extends into the path of tubes 32 traveling in the elevator station. Thus, a tube striking arm 148 sends a signal to the computer control member that a tube is about to pass over curved segment 146 and into trough 64. The computer control member can thus stop elevator motor 142, preventing tube 32 from entering trough 64.

As shown in FIG. 9, trough 64 is defined by side wall 72, inclined side wall 150, side wall 96 and stopper plate 152. The openings in side wall 106, bottom 108 and curved segment 146, to allow the protrusion of hook bodies 118, are continued in side wall 150. Since tubes 32 fall onto bottom segment 154 of side 72 and are thereby offset from hooks 60, hooks 60 can pass out of trough 64 while tubes 32 remain.

As previously indicated, side wall 72 is pivotally attached to trough 64. Such pivotal attachment, shown in FIG. 9, is achieved by securing bottom 154 to side wall 150 by a hinge and spring arrangement. Since such hinge and spring arrangement is deemed known, only hinge pin 156 is shown in FIG. 9.

One end of trough 64 is defined by stopper plate 152. Stopper plate 152 serves to prevent tubes 32 from passing from trough 64 through opening 158 in side wall 98 to alignment assembly 66 until the appropriate time in each cycle. Stopper plate 152 is moved toward and away from opening 158 by double-acting air cylinder 160 through movement of piston 162 to which the stopper plate is attached. Thus, when the computer control member determines the appropriate time for passage of a tube 32 from trough 64, a signal is generated which serves to actuate cylinder 160 retracting piston 162 and moving stopper plate 152 away from opening 158.

As described above, once a tube 32 falls from elevator station $S_E$ into trough 64, it is given a predetermined radial orientation by orientation station $S_{RO}$. As shown in FIGS. 8–10 and more particularly in FIGS. 14–18, orientor station $S_{RO}$ operates to position an orienting collar 164 on the end of tube 32 opposite stopper plate 152. The orientor assembly moves collar 164 onto the end of tube 32 by first passing through opening 166 in side wall 96 and into slot 168 in the bottom of trough 64. A cup-shape cover 170 is mounted to side wall 96 over opening 166 to protect the orientor components. The orientor assembly is slidably mounted on rods 172 and 174 by mounting bracket 176. Rods 172 and 174 are securely attached at each end to side wall 98 and cover 170. Thus, by moving bracket 176 axially along rods 172 and 174, the orientor assembly is moved towards and away from stopper plate 152. To this end, a double-acting air cylinder 178 is mounted in a fixed position relative to rods 172 and 174 by mounting plates 180 and 182, which plates are secured to rods 172 and 174 by any suitable means which prevents axial movement thereon. Piston 184 is provided with threads at its far end, which end is screwed into a suitably threaded bore in bracket 176. Since the application of a relatively softer force by station $S_{RO}$ on the end of tube 32 is desirable, spring 186 is mounted between bracket 182 and bracket 176. Spring 186 is operable upon bracket 176 through its attachment to post 188 attached to orientor cylinder 190 which in turn is securely attached to bracket 176. Thus, after piston 184 has been extended, spring 186 serves to initially slide mounting bracket 176 axially on rods 172 and 174 moving orientor station $S_{RO}$ towards stopper plate 152. As will be later explained, when it is desirable to apply greater force on tube 32, piston 184 is retracted.

Figure 15:
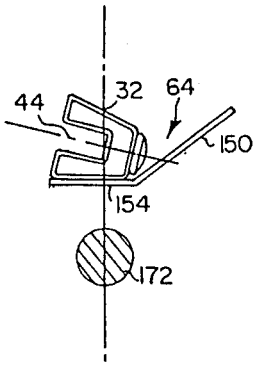
FIGS. 15 and 16 are sectional views taken on lines 15—15 and 16—16 of FIG. 14.

Consider next the detailed function and operation of orientor collar 164. FIG. 15 shows a tube 32 which has fallen into trough 64 in a random orientation. Tube 32 is generally A-shaped having a slot 44, which slot will always be positioned between the rows of DIP leads. It is the orientation object to position collar 164 over tube 32 so that a fixed reference of collar 164 is positioned in slot 44. To this end, collar 164 is provided within an inner ring 192 having a radially inwardly directed key 194. Key 194 is sized to fit within slot 44 and with relationship to the inner radius of ring 192 is sized to allow ring 192 and thus collar 164 to pass over tube 132.

Rotation of collar 164 results in rotation of ring 192 and key 194. Such rotation is effected through the structure shown in FIGS. 8 and 14. Collar 164 is shown to be internally threaded and mounted on the end of suitably threaded body 196. Ring 192 is fixed in relation to collar 164 by its frictional engagement between collar 164 and shoulder 198 formed in the end face of body 196. Body 196 is formed on a hollow shaft 200 which is rotatably mounted to bracket 176 through opening 202 by bearings 204 and 206. A toothed gear 208 is fixed to the end of shaft 200. Chain 210 connects gear 208 to gear 212 which in turn is securely attached to the shaft of rotary air cylinder 190. Thus, operation of cylinder 190, resulting from an appropriate signal from the computer control member applying air thereto, effects the rotation and direction of rotation of ring 192. Application of "return" air will generate the return of the cylinder shaft to an initial, i.e. "home", position. If collar 164 and ring 192 are in position around tube 32, generation of such "return" rotation results in the rotation of tube 32 to a fixed, i.e. "home", radial orientation. In the preferred embodiment such fixed position is that shown in FIG. 12.

Figure 11:
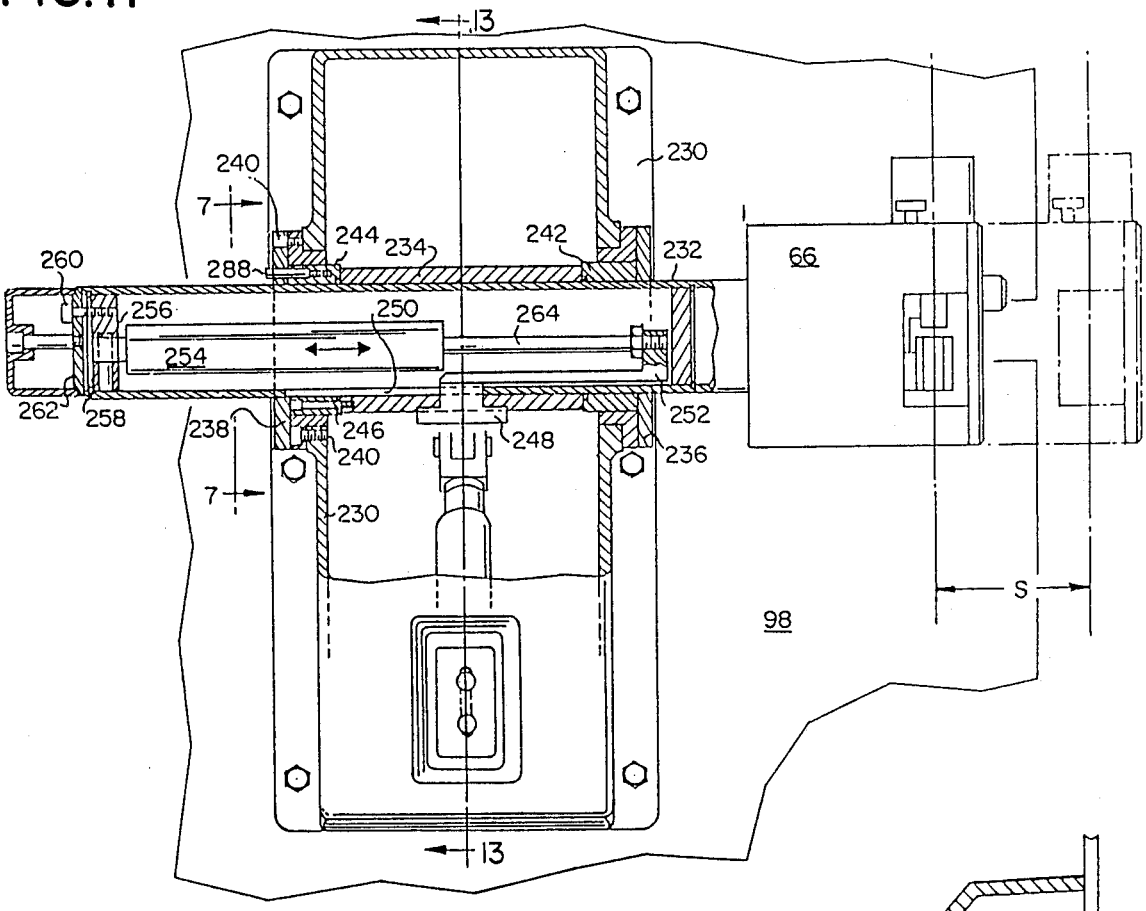
FIG. 11 is a fragmentary sectional view taken on lines 11—11 on FIG. 8.
Figure 14:
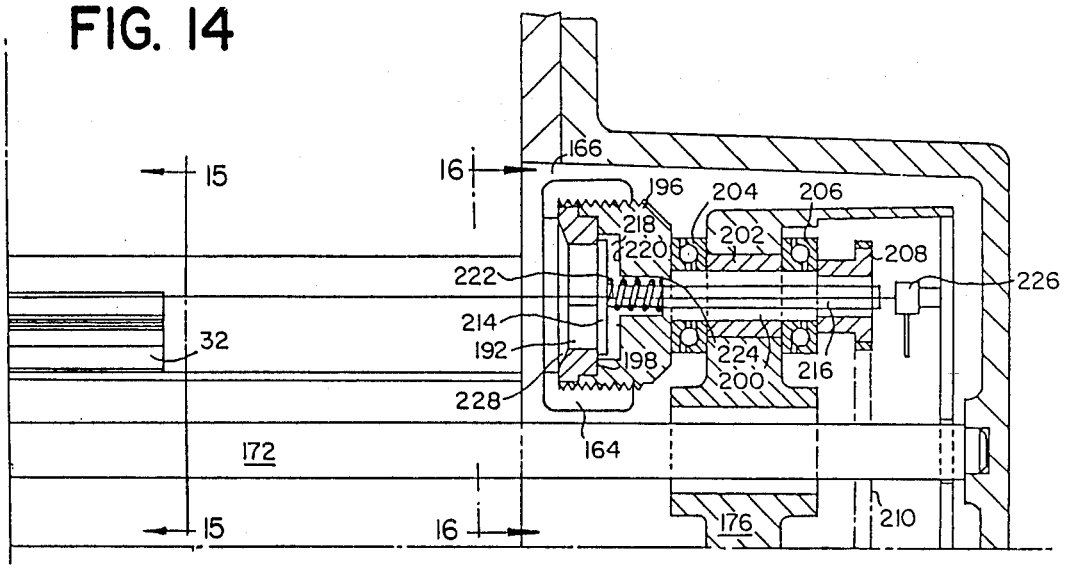
FIG. 14 is a partial sectional side elevational view of the orientor station showing the tube orienting mechanism.
Figure 16:
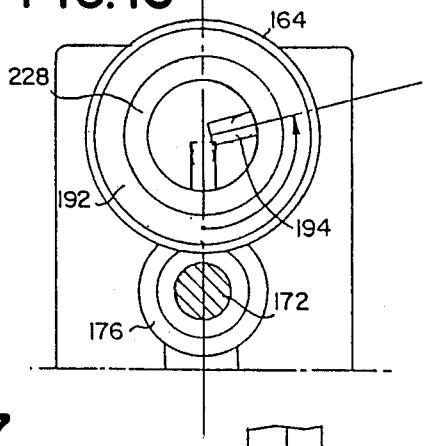
Figure 18:
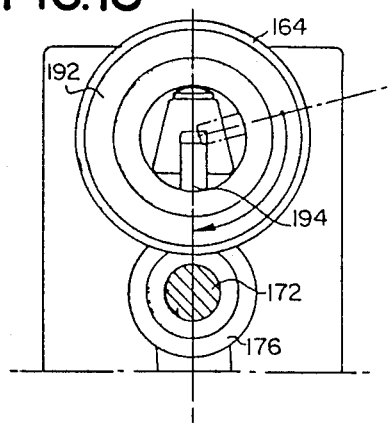
FIG. 18 is a sectional view taken on lines 18—18 of FIG. 17.
Figure 17:
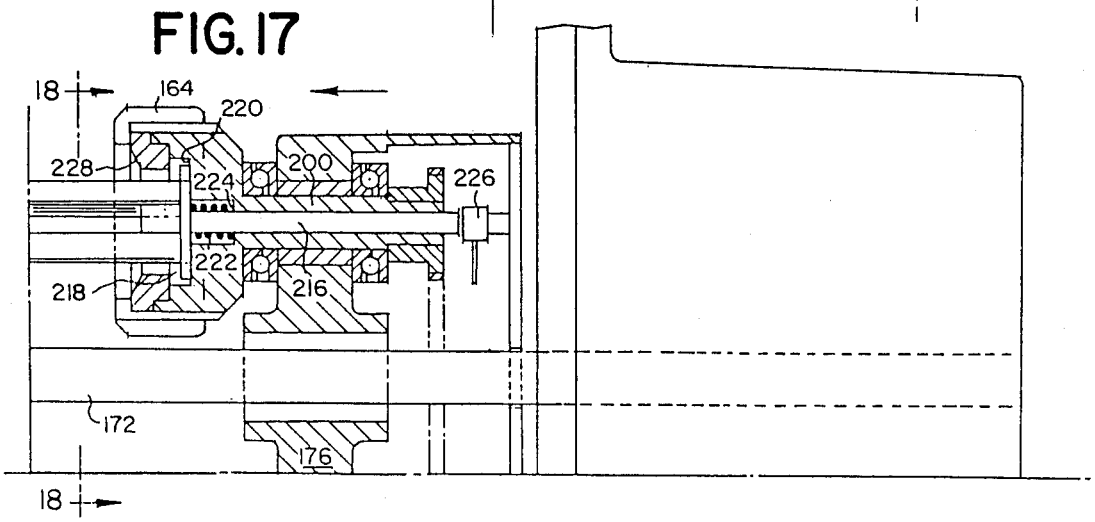
FIG. 17 is a partial sectional side elevational view of the orientor station showing the delivery tube engaged in a predetermined radial orientation.

As may already be apparent, the orientation process involves positioning collar 164 around tube 32 and rotating tube 32 to a fixed "home" radial orientation. Collar 164 is positioned around tube 32 in the following sequence. After tube 32 has dropped into trough 64, the computer control member stops pressurized air from entering cylinder 178. Spring 186, which is tensioned by the extension of piston 184, forces bracket 176, and thus the orientor assembly, towards stop plate 152. While bracket 176 is moving, cylinder 190 begings to rotate, resulting in the rotation of ring 192. As the now rotating ring 192 moves through slot 168 in trough 64, it strikes one end of tube 32 and forces the opposite end against stop plate 152. With tube 32 held axially stationary between stop plate 152 and ring 192, ring 192 continues to rotate until key 194 is aligned with slot 44. Upon alignment, spring 186 forces the axial movement of collar 164 and ring 192 onto tube 32. Ring 192 continues its rotation until the end of tube 32 passing through ring 192 contacts base 214. Base 214 is fixed to the end of shaft 216 which extends through, and is axially slidable in relation to, the hollow central portion of shaft 200. Base 214 is positioned in chamber 218 of body 196, which chamber is defined by the back surface of ring 192 and body shoulder 220. Base 214 is biased against the back surface of ring 192 by spring 222, which is positioned around shaft 216 and which has one end against base 214 and the other end against shoulder 224 of body 196. The striking of base 214 by tube 32 forces the opposite end of shaft 216 towards proximity switch 226. When the axial movement of base 214 is stopped by shoulder 220, as shown in FIG. 11, the end of shaft 216 is sufficiently close to proximity switch 226 to cause the generation of a signal to the computer control member. Thus, the computer control member is provided a signal reflective of the positioning of key 194 in slot 44, whereby the counter-clockwise rotation of collar 164 shown in FIG. 16 is halted and the clockwise or return rotation to the "home" radial orientation of collar 164 is initiated. As shown in FIGS. 14 and 18, ring 192 is provided with a radially inwardly tapered surface 228 to facilitate the alignment of key 194 with slot 44.

As indicated, after tube 32 has been radially oriented by the previously described orientor station $S_{RO}$ and after stop plate 152 has been removed and tube 32 inserted into head or alignment assembly 66, an operation yet to be described, the head member or alignment assembly is moved to a second position, whereby tube 32 is moved out of trough 64. Such movement is achieved by arm assembly 70, generally shown and designated in FIG. 4. As shown in FIG. 11 arm 70 is contained in housing 230, which is bolted or otherwise securely attached to side wall 98. The movement of head member 66 is basically the result of the axial and radial movement of arm 232.

Arm 232 is positioned within sleeve 234, which in turn is held axially fixed within housing 230 by end plates 236 and 238 which are securely attached to housing 230 by bolts 240. As shown in FIG. 5, end plates 236 and 238 actually restrain axial movement of collars 242 and 244, respectively. Collars 242 and 244 are, in turn, securely attached to sleeve 234 by bolts 246. Base bracket 248 extends through and is securely attached to sleeve 234. Bracket 248 additionally extends through slot 250 in arm 232 and has an end plate 252 displaced axially therein. A double-acting air cylinder 254 is securely attached at one end to crosspiece 256. Crosspiece 256 is fixed against a ring 258 fitted proximate the end of arm 232. The fixation of crosspiece 256 occurs by passing bolt 260 through end plate 262 and into the crosspiece. Piston 264 is provided with a threaded end which is shown screwed into a suitably threaded bore in end plate 252. Thus, it will be seen that retraction of piston 264, in response to a signal from the computer control member, results in axial extension of arm 232 moving head member 66 to a second position shown in dot/-dashed form in FIG. 11. Extension of piston 264 results in the return of head member 66 to its first "home" position. It will be noted that the distance S of axial displacement is determined by the length of movement of slot 250 around that portion of bracket 248.

Figure 12:
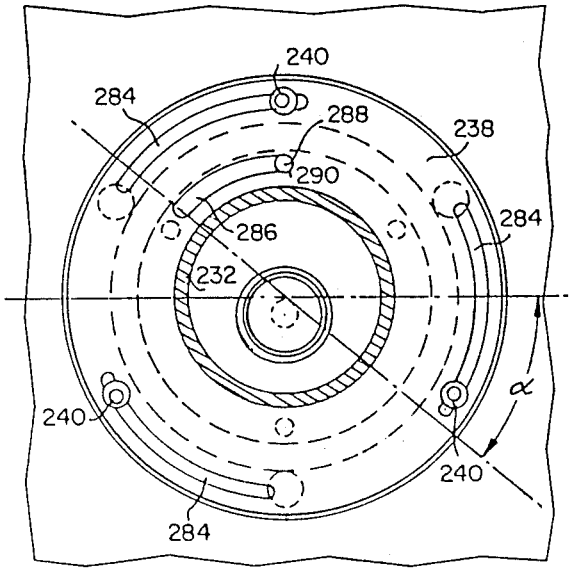
FIG. 12 is a sectional view taken on lines 12—12 of FIG. 11.

Rotation of arm 232 and thus head member 66 is accomplished largely through the structure shown in FIG. 12. A bracket 266 is securely attached to sleeve 234. It will be appreciated that bracket 248, while allowing axial movement of arm 232, acts as a key between sleeve 234 and arm 232 in relation to rotational movement. Thus, rotation of sleeve 234 also serves to rotate arm 232. A double-acting air cylinder 268 is pivotally attached at one end to mounting bracket 270 by pin 272. Bracket 270 is attached to housing 230 by passing bolts 274 through plate 276, slot 278 and into suitably threaded bores in bracket 270. The end of piston 280 is pivotally attached to bracket 266 by pin 282. Extension or retraction of piston 280 results in the rotational movement of sleeve 234 and thus, arm 232 and head member 66.

Figure 13:
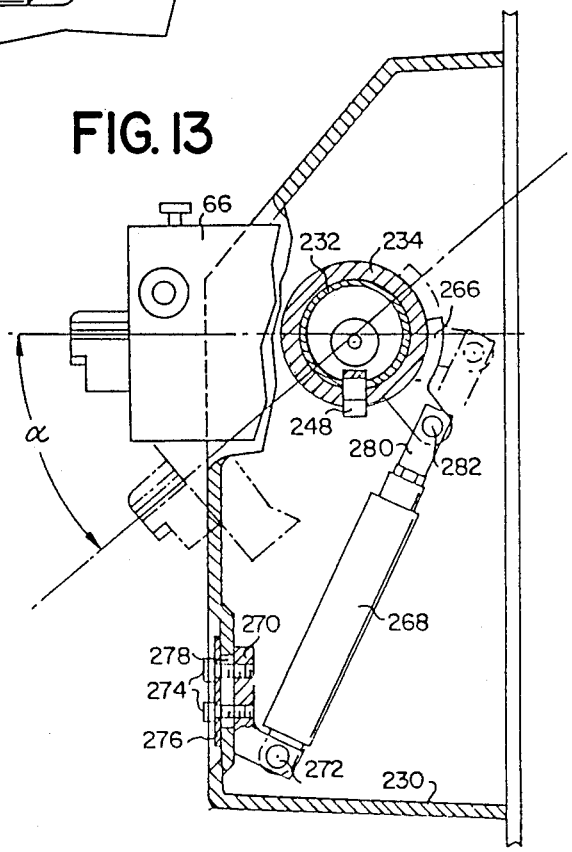
FIG. 13 is a fragmentary sectional view taken on lines 13—13 of FIG. 11.

As previously indicated, it is desirable to rotate head member 66 to a position where trackway 68 is in alignment with a trackway of a separate device. The example given was an angle of 40°. This angle is fixed by the structure of end plate 238 shown in FIG. 13. Plate 238 is provided with several outer arcuate slots 284 through which bolts 240 pass and attach the plate to housing 230. An inner arcuate slot 286 is provided which allows for the arcuate travel of pin 288. As shown in FIG. 11, pin 288 is securely attached to end collar 244. Since collar 244 is fixed in relation to sleeve 234 by bolt 246, the rotational movement of sleeve 234 is restricted by end 290 of slot 286. When piston 280 is retracted, pin 288 will be in the dashed position shown in FIG. 13, having moved in an arcuate path of equal degrees alpha will be increased. The limit on alpha is the arcuate length of slot 286. The loosening of bolts 274 allows for the adjustment of bracket 270 and thus the return position of piston 280 and resulting orientation of head assembly 66.

Considering now more specifically, the structural details and arrangement of the head assembly 66 and with particular reference to FIGS. 19–28 inclusive, the head assembly is comprised of a number of machine elements arranged in a generally rectangularly-shaped housing having a tube input end 292 and a DIP device output end 294 including a short trackway section 68 adapted in the discharge position of the head assembly to align with trackway 54 on a DIP processing apparatus such as a scanning or lead straightening apparatus. (See FIG. 1) As was previously described, after radial orientation of tube T to a "home" position, stop plate 152 is displaced from opening 158 and simultaneously piston 184 is retracted which consequently forces tube T through opening 605 into the tube input end 292 of head assembly 66.

Figure 21:
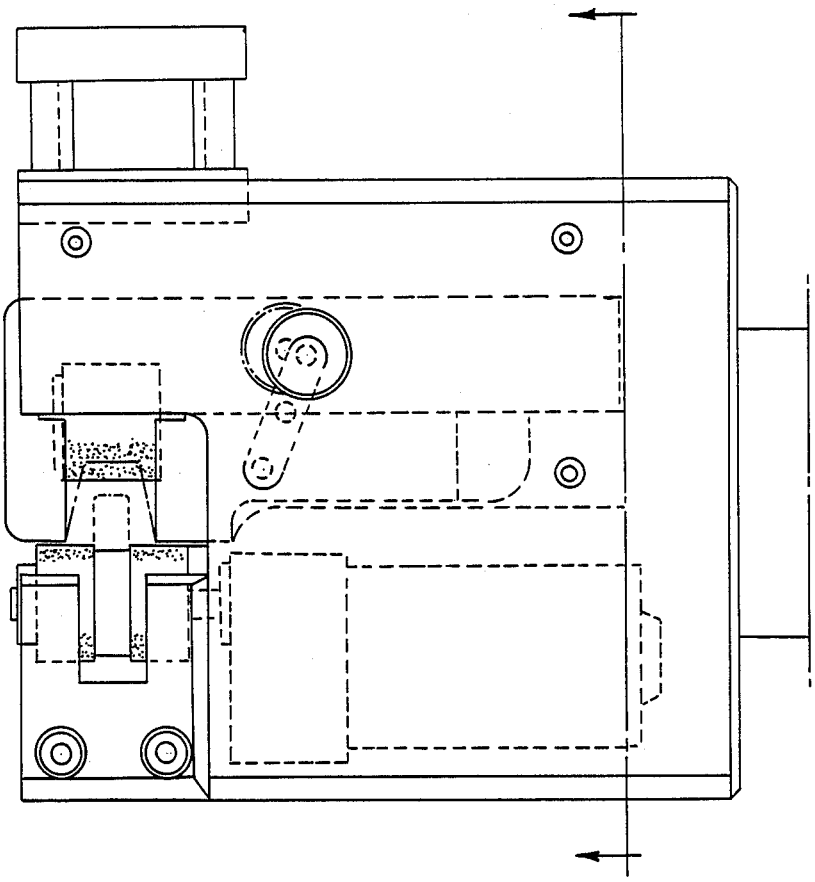
FIG. 21 is a view of the orientor head taken as seen along lines 21—21 of FIG. 19.
Figure 22:
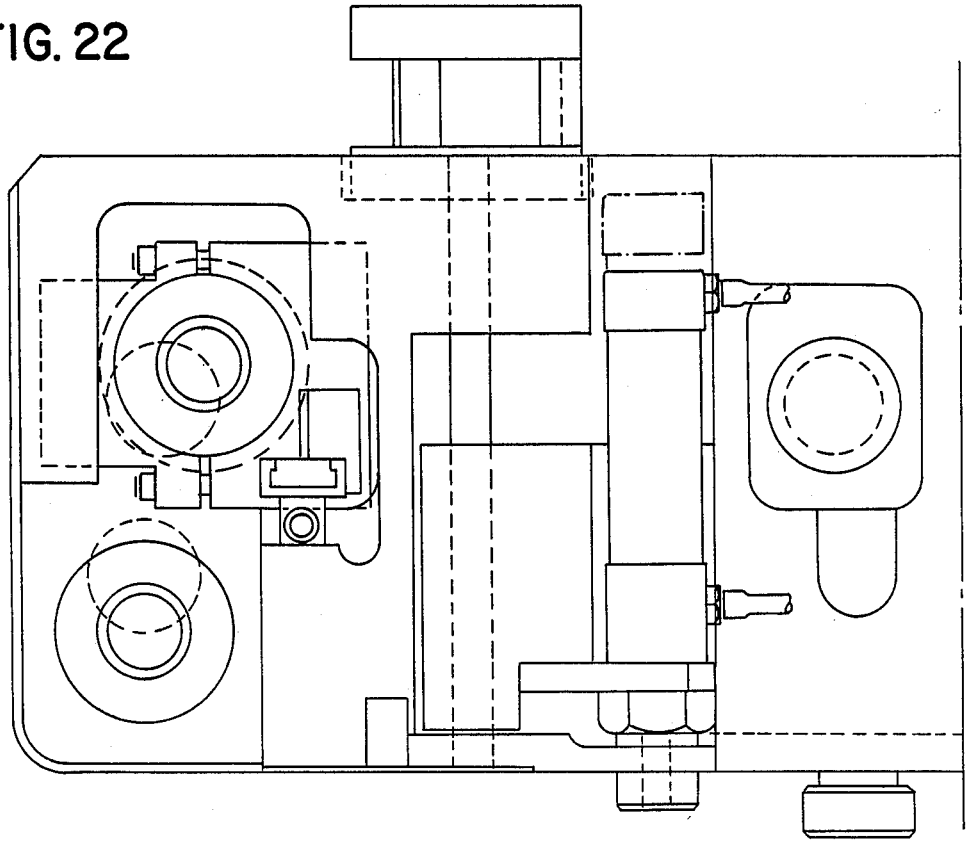
FIG. 22 is a sectional view taken on lines 22—22 of the FIG. 21.
Figure 23:
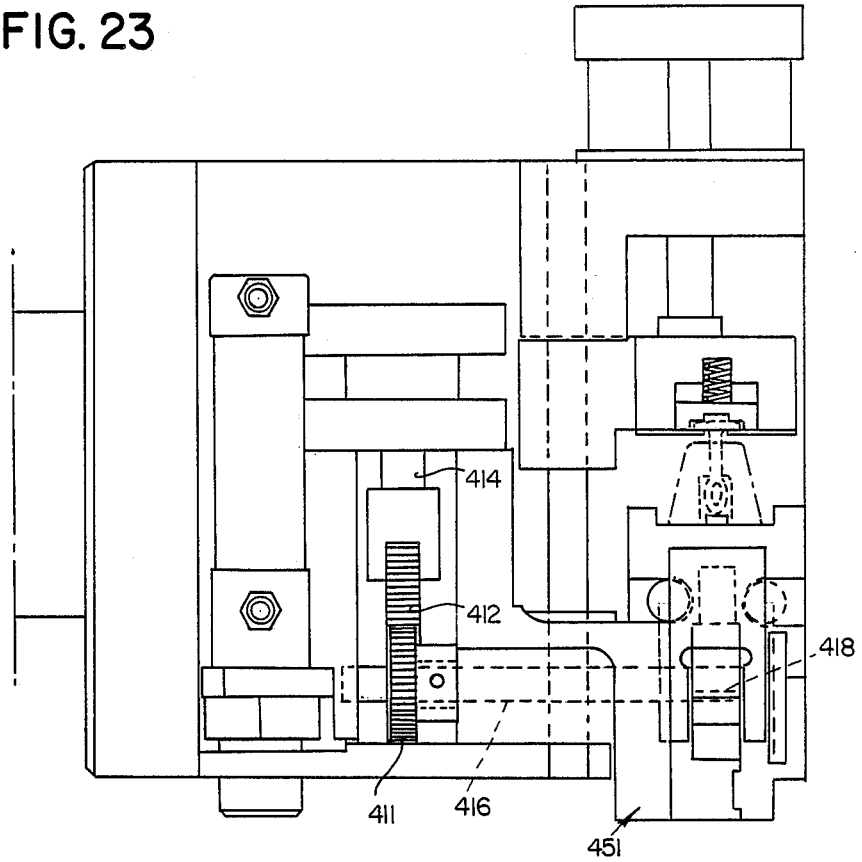
FIGS. 23 and 24 are enlarged sectional views taken on lines 23—23 and 24—24 of FIG. 19 showing some of the internal mechanisms of the orientor head.

The entrance 292 to head assembly 66 is defined by a pair of adjustable guide shutters 600, 601 movable transversely relative to the discharge trackway $T_D$ and includes a mechanism 603 for simultaneously displacing the shutter doors relative to the axial center line B—B of the discharge trackway $T_D$. The actuating mechanism moves the shutters simultaneously inwardly or outwardly with respect to the center line B—B to thereby selectively vary the size of the entrance opening 605. It is noted that the cross-sectional width of tubes vary from one type of DIP carrier tube to the next and, hence, having an entrance opening 605 tailored to a specific tube ensures accurate guiding of the tube through the head assembly. The shutter actuating mechanism comprises, as best illustrated in FIG. 21, a link 607 pivotally mounted for rotation about a fixed center point. Link 607 is pivotally connected at opposite terminal ends 611, 613 to the respective shutter guide plates 615, 617. Knob 619 is provided for selectively pivoting the link in an arcuate path to move pin 621 engaging in an arcuate slot 623 which then slides the doors linearly toward or away from one another to selectively open or close the entrance opening to the head assembly.

Figure 20:
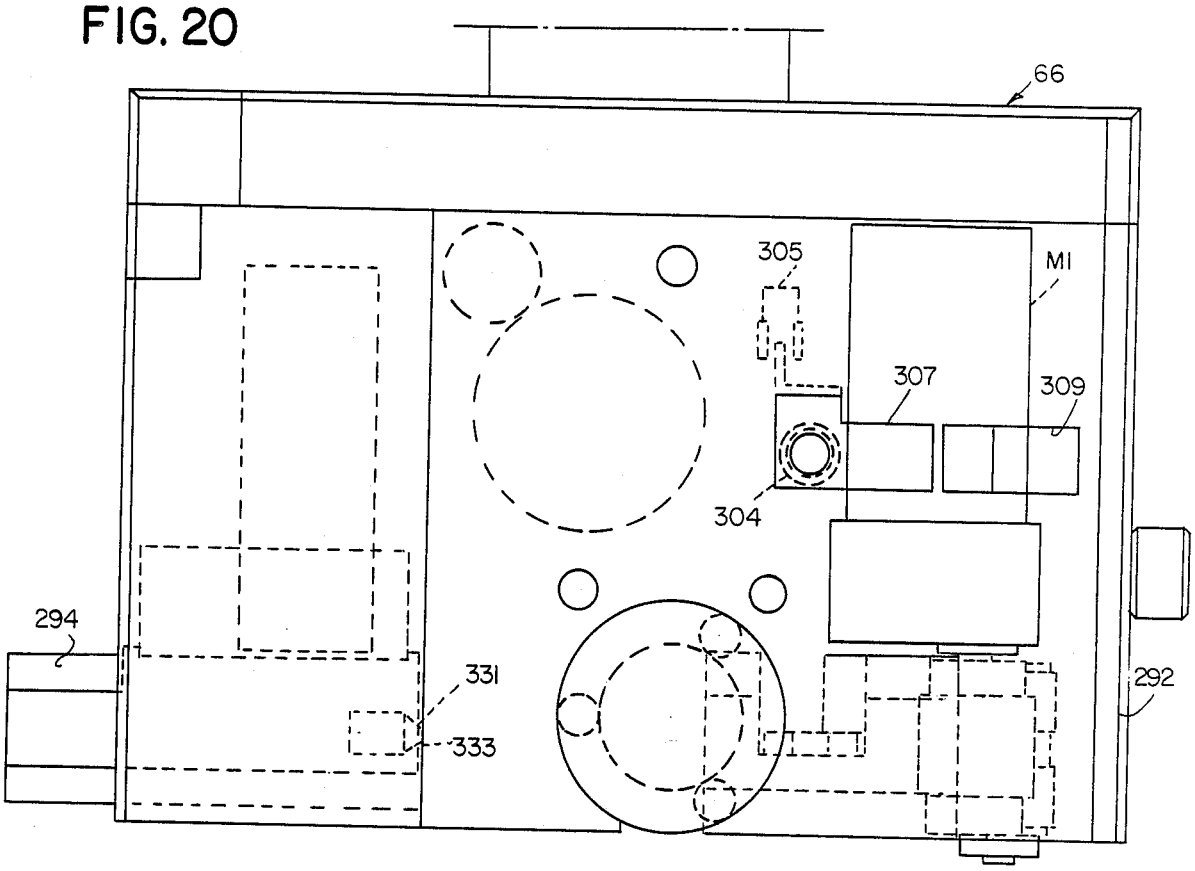
FIG. 20 is a top plan view of the orientor head shown in FIG. 19.
Figure 19:
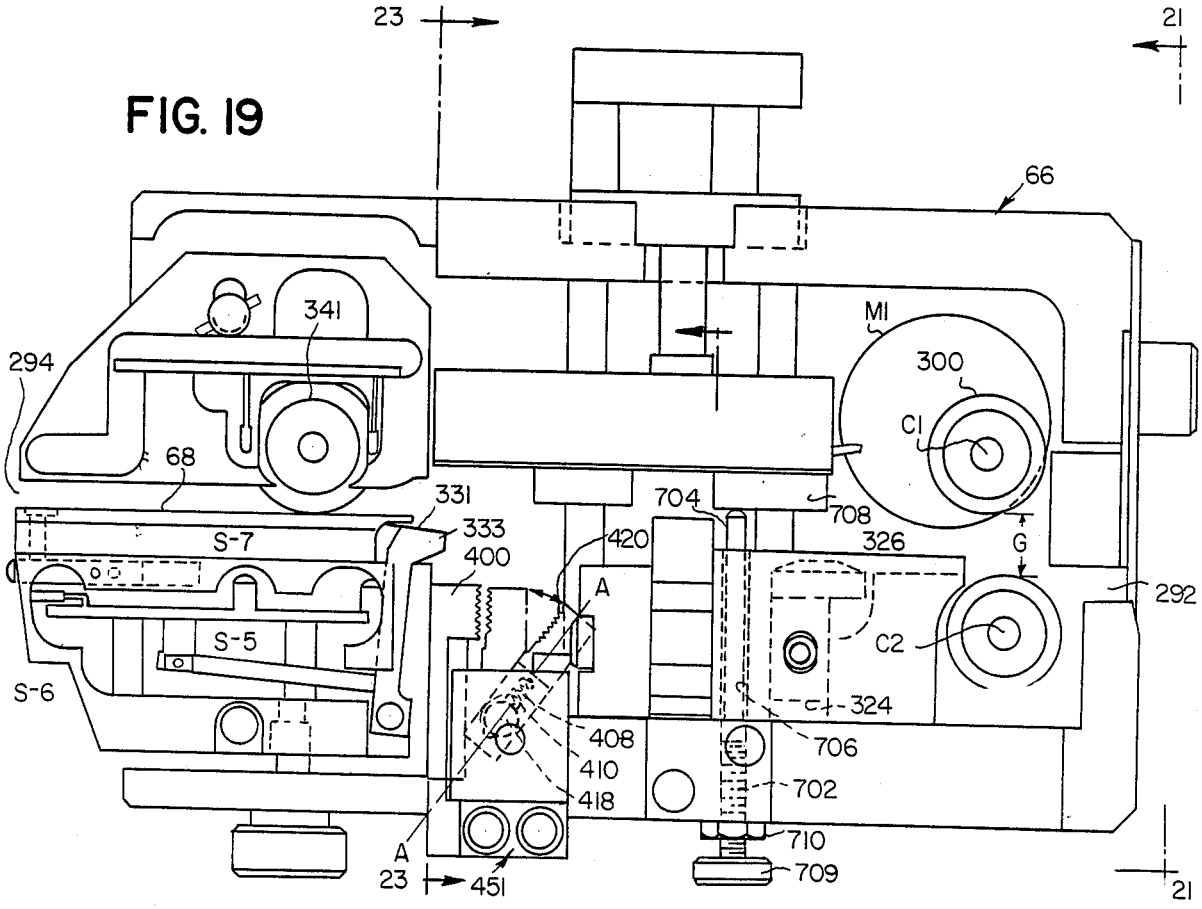
FIG. 19 is a side elevational view of the orientor head assembly in accordance with the present invention.

As best illustrated in FIGS. 19 and 20, tube 32 is engaged and driven forwardly into the head assembly by a pair of upper and lower drive rollers 300 and 302 which, as illustrated, have longitudinally staggered centers $C_1$ and $C_2$ to effect a downward driving action to the tube. The upper roller 300 is mounted for floating movement in a vertical direction and is normally spring biased by spring means 304 to a lower limit position wherein the gap G between the rollers is less than the height of a tube so that a tube entering the head assembly will displace the upper roller 300 upwardly. This action exposes sensor 305 to a signal logic circuit that a tube is entering the head assembly. As best illustrated in FIG. 18, upper and lower rollers 300 and 302 are separately driven by motors $M_1$ and $M_2$, the upper roller assembly being mounted in a split brackets 307, 307*a*. Bracket 307*a* rides on shaft 307*b*. Guideway 309 prevents split bracket 307 from rotating on shaft 307*b*. The motor driven means for the rollers, as explained in more detail below, is operable to activate the tubes into the head assembly in one cycle for discharge of DIP devices to rotate the rolls in an opposite direction to eject the empty tubes in a manner to be described in more detail below. The motor drive means is also operable under control of the computer control system to effect a pulsing action to the tube or agitation thereof to discharge DIP devices which may be stuck in the tube.

In FIGS. 19–26 inclusive, the head assembly is configured to accommodate tubes having pins at opposite ends of the tube to retain the DIP devices. As explained in detail below, the head assembly may be configured via the computer to remove plugs, in which event a plug module is activated in position. Considering now the first mode, as the tube is deiven into the head assembly by the drive rollers, it passes over a finger 324 having a cam surface 326. As pin P passes over cam 326, the terminal tip end engages the same and forces the pin head slightly upwardly from the top surface and in this slightly raised position, the pin head engages in channel 336 of pin pulling assembly 328 which is in a lower position. Pin pulling assembly 328 basically includes a double-acting air cylinder 330 attached to frame 314. The actuator piston 332 passes through frame 14 and is attached to pin pulling assembly 328. The pin pulling assembly includes body portion 334 in which is formed slot 336.

Figure 24:
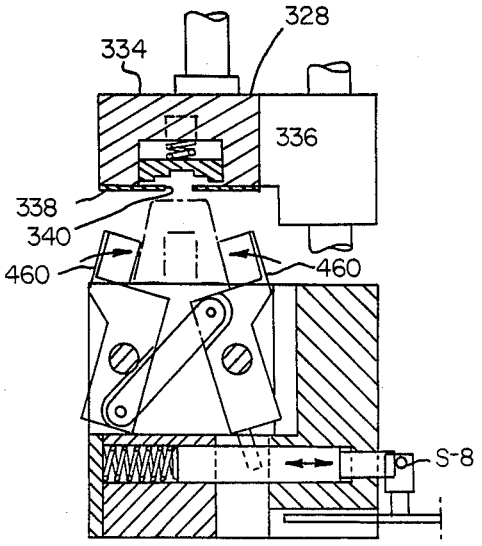
Figure 25:
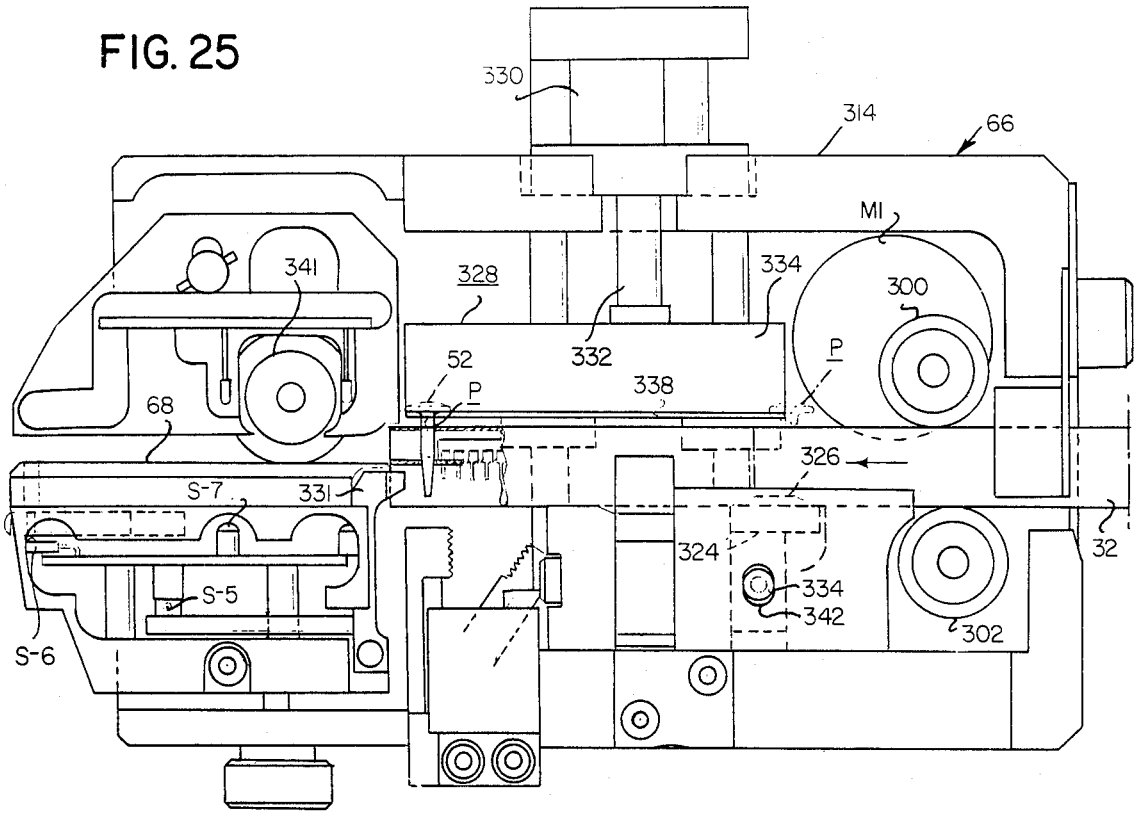
FIG. 25 is a side elevational view of the orientor head similar to FIG. 19 showing a tube in pre-delivery position prior to removal of the pin.
Figure 26:
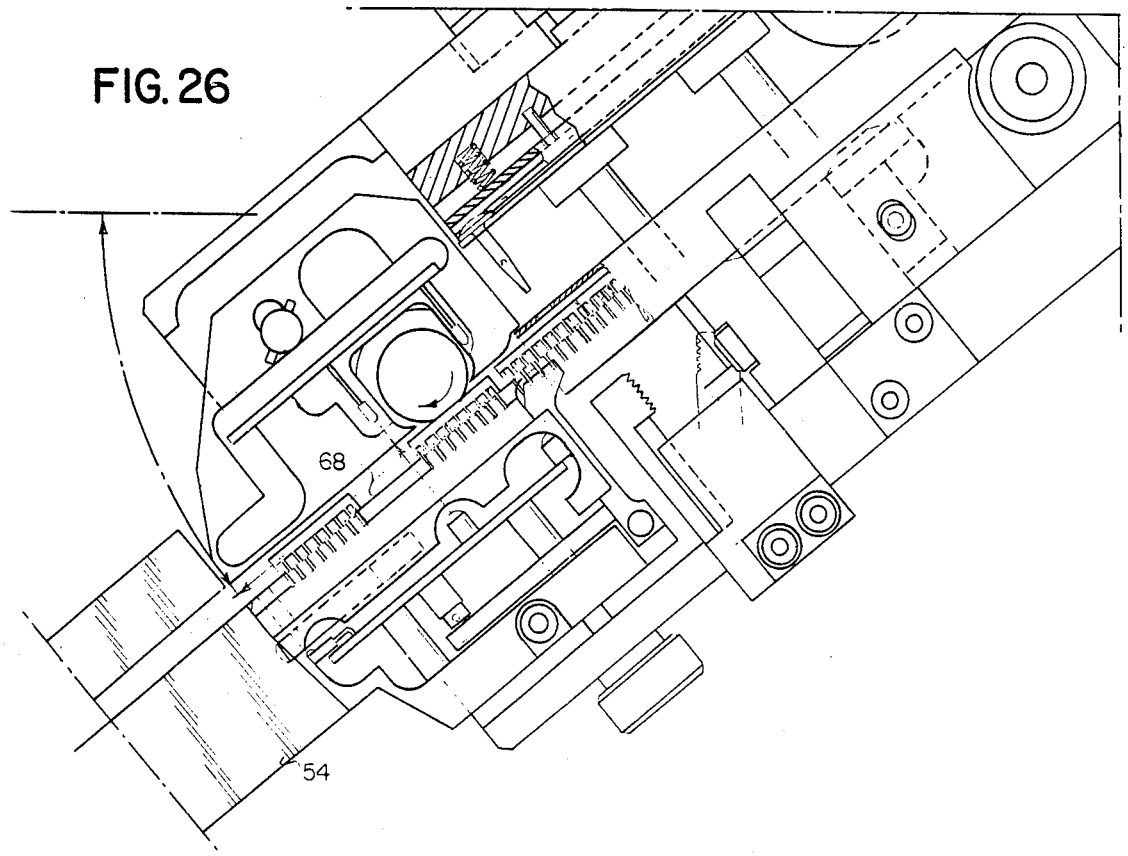
FIG. 26 is a view similar to FIG. 25 showing the orientor head and parts in a position delivering DIP devices from a tube.

As seen in FIG. 24, the pin-puller mechanism includes a biasing member in the form of an elongated plate 650 mounted in channel 336 biased by spring 652 to press the plate against the head of a pin and lock it in a predetermined fixed position in the channel to ensure proper alignment with its opening in the end of the tube during the reinsertion cycle. Plate 650 has a stepped, top hat-like cross-section to conform securely to various head cross-sectional configurations. The spring biased plate has a lead-in tapered ramp 654 to allow smooth entry of pin heads. Covering slot 336 and securely attached to body 334 are spaced base plate 338, 338*a* defining slot 340. Base plates 338, 338*a* are relatively thin and sized to fit under the slightly raised pin head 52. The forward part of base plates 338, 338*a* are provided with tapered surfaces to help raise pin head $P_M$ should a problem occur with surface 326. The slot 340 is formed substantially along the length of base plates 338, 338*a* and are sized wider than the stem or shank portion of pin P but not as wide as pin head $P_H$. Thus, after tube T has been fully inserted by motor driven 300, 302 into head member 66, pin head $P_H$ will be well within the pin grasping assembly. A retraction of piston 332 will result in pin P being pulled from tube 32. As is now apparent, extension of actuator 332 will result in the re-insertion of pin P in tube 32.

As best illustrated in FIG. 19, the lower limit position of pin-puller mechanism 328 is selectively adjustable manually by means of a threaded adjusting bolt 700 engageable in a tapped bore 702 in the housing 66. The inner terminal end 704 of the bolt engages the pin puller block which determines the lower limit position of the puller mechanism. This arrangement permits fine adjustment to accommodate tubes of various differing heights. A lock nut 710 is utilized to fix a given lower limit position for the pin-puller mechanism.

Finger 324 is provided with slot 342. By passing bolt 334 through finger 324 and through lot 342, the height or distance by which pin head 52 can be raised is capable of adjustment.

As the forward end of the tube is advanced further ionto the head assembly by the drive rolls, the forward end of tube 32 will engage pivotally mounted linkage 331 which is normally forwardly pivoted to block sensor S-5. When it is engaged by the tube, sensor S-5 is activated and through the logic control circuit, effects movement of the head assembly laterally outwardly to the discharge position shown in broken lines in FIGS. 10 and 11. Head 333 of linkage 331 is duckbill-shaped to engage in the central channel of tube T and align it for smooth discharge of DIP evices to the discharge trackway. When the control arm for the head assembly is fully extended, the head assembly is rotated about its pivot axis angularly to the position shown in FIG. 26 in alignment with trackway 54 of a scanning or straightening apparatus. When the head assembly discharge trackway 68 and scanner or straightening trackway are in registry, sensor S-6 is activated which cycle pin actuator 330 and raises it upwardly to the position shown in FIG. 26 thereby freeing DIP devices for discharge along the discharge trackway 68 and sensor S-6 is activated, showing closure with track 54 and when blocked by a DIP will not allow rotation of head until blocked condition is cleared. Simultaneously, singulator wheel 341 is activated to ensure proper discharge and spacing of the DIP devices along the discharge trackway. It is noted that during discharge of DIP devices in the manner shown in FIG. 26, sensor S-7 counts the DIP devices. Sensor S-9 to the right of singulator wheel 341 counts DIP devices flowing in the opposite direction as, for example in the lower DIP handling assembly shown in FIG. 1.

After the counter S-7 has decremented to zero, the pin assembly is recycled to re-engage the pin in the discharge end of the tube. The computer control is then activated to return the head assembly to the level position providing all sensors on the trackway are clear. Thereafter, the drive motors $M_1$ and $M_2$ are activated in a retract mode to discharge the empty tube with the pin reinserted to a storage hopper $B_1$. The head assembly is then returned to the "home" position to receive another filled tube and initiate the cycle described above. On the other hand, if the counter S-7 does not decrement to zero, the motors $M_1$ and $M_2$ are pulsed to agitate the tube in the manner described later. Specifically, rollers are activated in alternating directions to engage and disengage duck bill linkage to open and close sensor S-5. After an agitation cycle, the head assembly is returned to the level position provided all sensors on the trackway are clear and the tube is ejected from the head assembly and then the head assembly is returned to its "home" position. The pin pulling mechanism is then activated to its lowered position with the pin still in place. It is noted that during the next cycle, the pin so held will be ejected from the pin pulling mechanism channel.

Figure 27:
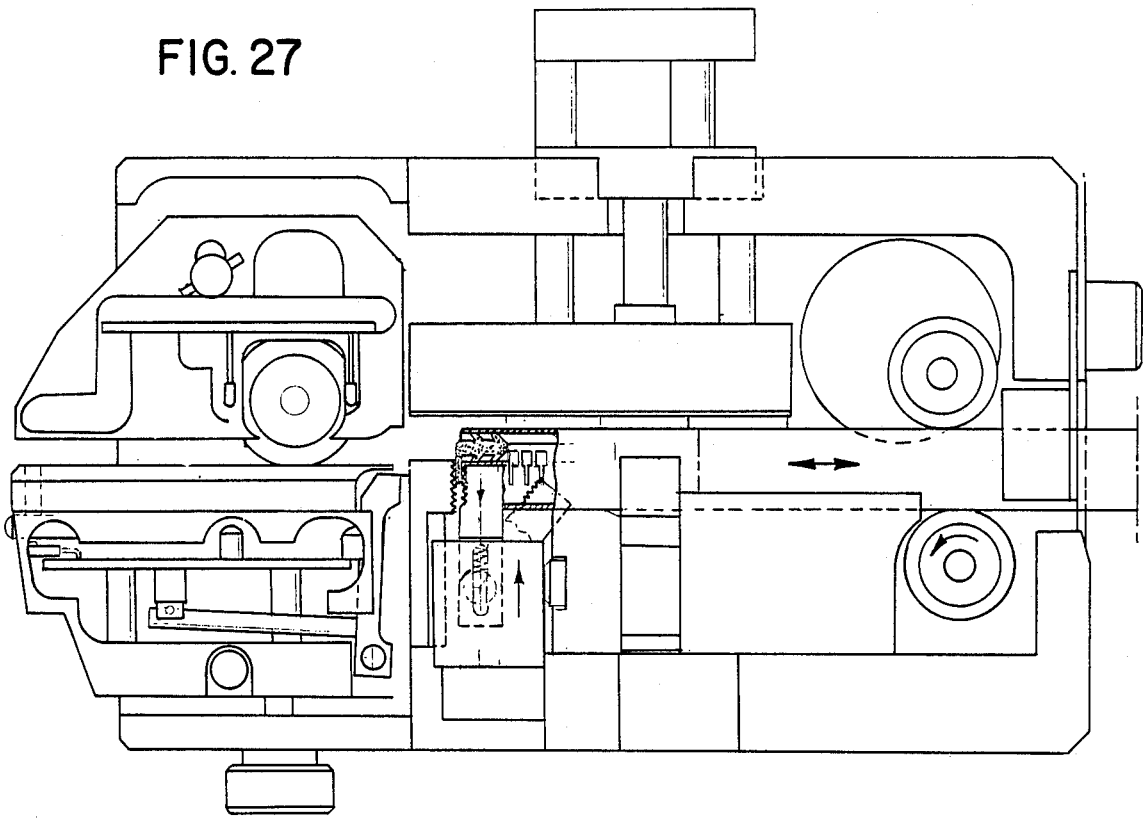
FIG. 27 is a side elevational view of the orientor head showing a plug removal module in position to remove a plug from a tube.
Figure 28:
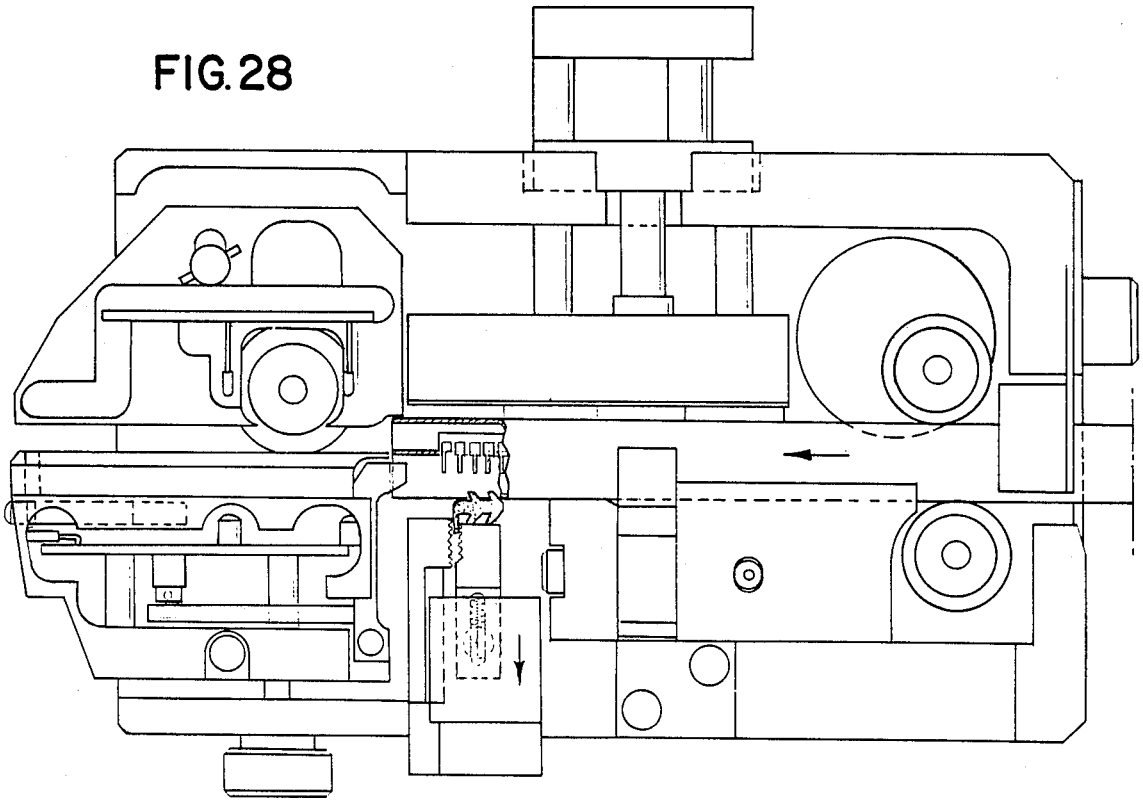
FIG. 28 is a view similar to FIG. 27 showing the plug removed and the tube being actuated to its next position.

Having considered the operation of the head assembly in relation to tubes sealed with pins, consider now the operation of the head assembly with tubes sealed with plugs and with particular reference to FIGS. 27 and 28. Consider, however, first the structural details and arrangement of the plug puller module. As illustrated, the module comprises an upstanding plug clamping plate 400 and a plug clamp member 402 actuatable between clamping and unclamped positions. Plug clamp 402 has an elongated slot 408 therein housing spring 410 which normally urges the plug clamp upwadly in a plant alligned with the longitudinal A—A axis of the slot 408 in the manner described below. Plug clamp 402 is actuated between clamped and unclamped positions by means of spur gear 411, gear rack 412 and piston cylinder actuator 414 which rotates spur gear 411 upon linear movement of rack 412. An elongated clamp shaft 416 mounted at one end of the spur gear 410, has a generally rectangular tang 418 at its opposite end which engages in the slotted opening 408 of the plug clamp and upon rotation of the spur gear effects pivotal movement of plug clamp 402 between clamped and unclamped positions. It is noted that the spring biasing movement permits positioning of the upper surface of plug clamp 402 as close as possible to the tube under surface to ensure a good purchase of the plug tab. For example, since the pivot axis of plug clamp 402 is not fixed and the plug clamp has a certain freedom of movement relative to the tang in the direction of the longitudinal axis of slot 408, the spring can urge the upper end of the plug clamp closely against the tube as it reaches the clamping position shown in FIG. 27.

Consider now the operation of the head assembly and assume the plug module 451 is in the operative position shown in FIG. 27. Note that in this position the plug clamp is disposed angularly in an unclamped position. Now as the tube is advanced by the driver rolls and engages the centering guides (FIG. 24), sensor S-8 is activated to start a plug pull timer T-1 which operates for a predetermined time interval. The tube then bottoms out against the serrated face 430 of the plug clamping plate and timer T-1 expires whereby the drive motors are stopped simultaneously effecting actuation of the clamp cylinder actuators whereby the plug clamp is actuated to a clamped position shown in FIG. 27. This also initiates a predetermined time for timer T-2 which, when it expires, drives rollers 300–302 reverse to move tube T to a position slightly rearwardly of the centering guides 406. During this interval, a plug is removed. Plug pull mechanism or module 451 is then lowered below the tube path while still in a plug clamping mode and the tube is then fed forward through centering guides 460 to the discharge trackway to engage the duck bill which, as indicated previously, actuates sensor S-5 to activate head assembly to an extended position. After the arm is fully extended the head assembly is tilted to the angular position shown in FIG. 26 to effect discharge of DIPs in the manner described above.

If sensor S-7 has decremented to zero, the head assembly is returned to the level position providing all sensors on the trackway are clear. When the tube is retracted out of the centering guides 460, the plug mechanism is raised and the tube is fed forward to effect reinsertion of the plug. Rack 412 is then cycled to move plug clamp 402 to its unclamped position releasing the plug and the tube is again retracted out of the centering guides 460. Drive rollers 300, 302 are actuated once more to feed the tube forwardly to engage the inserted plug T against serrated face 430 of plug clamping plate 400 to ensure a good tight sealing engagement of the plug in the end of the tube. The tube is then again retracted and ejected from the head assembly and the control arm returns the head assembly to the "home" position.

If the counter sensor S-7 has not decremented to zero and the agitation cycle is completed as described previously, the head is returned to the level position providing all sensors on the trackway are clear. The tube is then retracted out of the centering guides, the plug module is raised and the tube is fed forward to reinsert plug $P_L$. As before, plug $P_L$ is unclamped, the tube is retracted out of the centering guides 460 and fed forward once more to ensure a good fit. However, in this instance, the robot arm extends to the reject position to eject the tube from the head assembly and then the arm returns the head assembly to the "home" position.

It is noted that computer control system or member of the type shown diagrammatically in FIG. 19 of pending Linker application Ser. No. 807,531 incorporated herein fully by reference may be utilized to effect the controlled timed sequence of operation of the apparatus in the manner described above.

It is noted that in a typical programming for carrying out a cycle of operation, several manual steps are necessary to set the loader apparatus to transfer particular DIP devices as pointed out in the pending linker application Ser. No. 807,531. These steps include turning on the power, filling hopper 58 with tubes, entering the number of leads per DIP device which, as noted above, will indicate what size DIP is being transferred, the number of DIPs per tube so that the controller will have an indication when tube 32 is full or empty and whether the tube is sealed with plug 34 or pin 36. Once these manual steps are completed, automatic operation through the program can be initiated.

Figure 32:
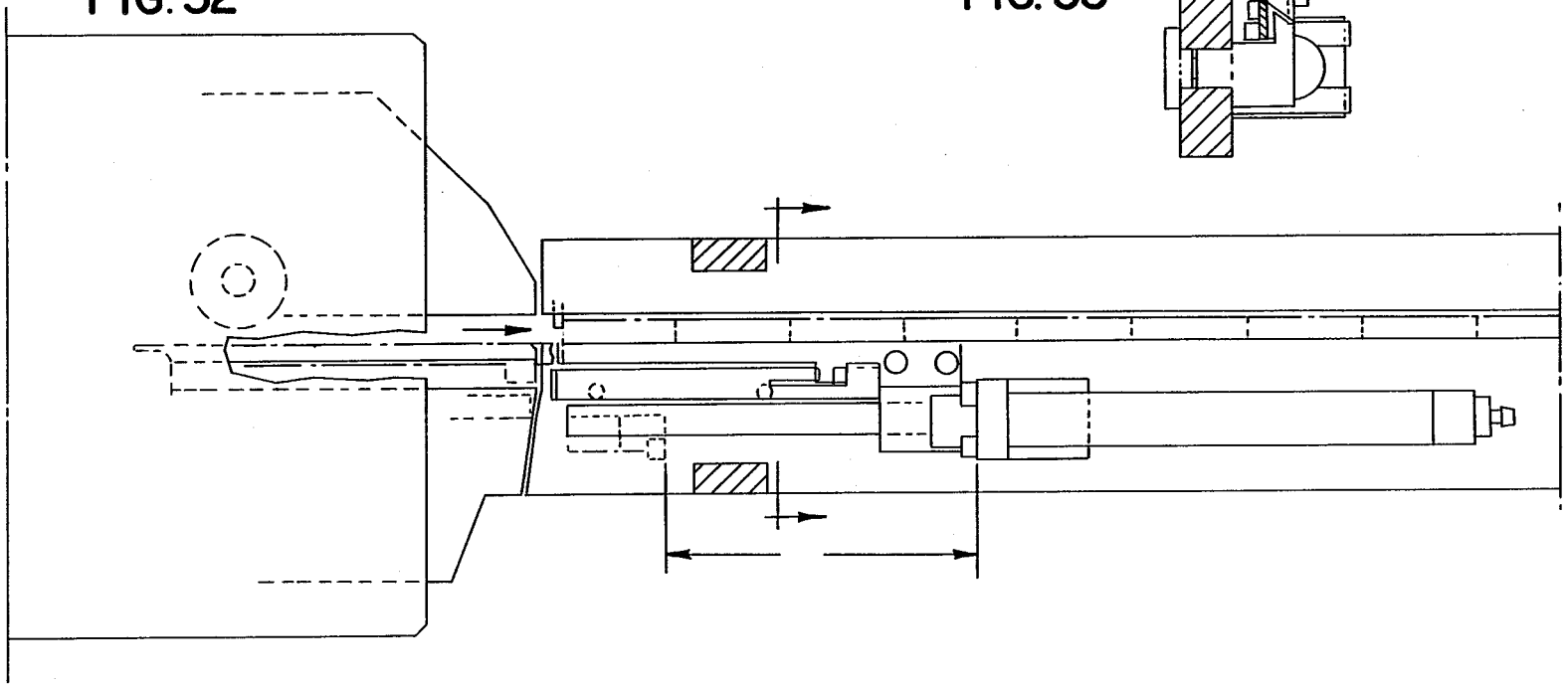
FIG. 32 is an enlarged sectional view taken on lines 32—32 of FIG. 31.

In accordance with another feature of the present invention, there is provided a novel DIP jam-correcting mechanism for clearing the trackway when DIP devices are jammed and is particularly suited for use in systems involving multiple DIP handling apparatus and connecting trackways of the type illustrated in FIG. 1. For example, it has been found that in the operation of the system shown in FIG. 1, DIP jamming may occur at the juncture of the lower trackway $T_4$ and what is described herein as the discharge trackway of the head assembly $H_L$. The DIP jam-correcting mechanism is mounted on trackway $T_4$ adjacent the discharge end thereof and comprises an elongated rake arm 500 of generally S-shaped configuration having at its outer free terminal end a hook portion 502 actuable longitudinally relative to the trackway by means of piston cylinder actuator 504 between opposing inner and outer limit positions. The inner end of rake arm 500 is mounted on guide block 506 which straddles the trackway $T_L$ and moves in an elongated slot 510 therein. The guide block 506 is connected to piston 507 of an actuator 504 which cycles rake arm 500 between the inner and outer limit positions. The assembly further includes an elongated cam element in the form of bar 514 mounted to a side face of the trackway $T_L$ having at one end an inwardly inclined ramp portion 516 to control the attitude of the rake arm during movement from its inner "home" position forwardly. More specifically, rake arm 500 has a cam follower in a form of a tang 520 adjacent the inner end thereof which upon movement of the rake arm from the "home" position forwardly engages inclined ramp 516 and thereby positions hook 504 at a spaced distance D from the side of the trackway so that it can bypass DIP devices which are in a jammed condition on the trackway. It is noted that the configuration of the rake arm and mounting thereof is such that the hook portion 502 is normally biased to a position engaging the side of the trackway. When the rake arm has reached its outer limit position (shown in broken lines), tang 520 rides off of cam bar 514 whereby hook 504 is displaced inwardly and upon the return stroke of the rake arm, DIP devices are moved rearwardly on the track $T_L$ out of the jam area. It is noted that during retracting movement of rake arm 502, tank 520 engages inboard of cam bar 514 to ensure positive engagement of hook 502 with a jammed DIP device. The mechanism further includes a seesaw-like hold down mechanism 550 operable to retain DIP devices from entering the lower loading station $S_L$ when the rake again is actuated to its "home" position. As illustrated in FIG. 32, the stop latch bar 551 has a tapered nose 553 spring biased downwardly by spring 555 and a small piston-cylinder actuator 557 to rock and open rail for free flow of DIP devices. At the "home" position, a leaf spring 552 is provided which urges the rake arm outwardly from the track to permit flow of DIP devices when it is desired to release the same via the seesaw hold-down mechanism which will do this on command.

Consider now a typical cycle of operation of the DIP jam-correcting mechanism described above. It has been found that jams usually occur at the juncture of the lower discharge trackway and the head assembly $H_l$ of the lower DIP handling apparatus. If DIPs are jammed in this area, for example due to burred, damaged or distorted ends of tubes, after a predetermined time delay, the rake actuator on signal from the singulator mechanism effects a cycling of the rake arm in the manner described above. In one complete cycle, the jammed DIPs are withdrawn from the trackway of the lower head assembly $H_L$ and accumulated in the position shown in FIG. 32 on the lower discharge trackway $T_L$. The tube mounted in the lower head assembly $H_L$ which may be partially filled is ejected by cycling the head assembly and a new tube is positioned in the head assembly in the manner described above. The seesaw hold-down mechanism is then signaled to release the DIPs accumulated and when all of the DIPs on the lower trackway have been discharged to the new tube, the head is again cycled to eject the tube filled with the jammed DIP devices to a reject bin. This is done as a precaution by reason of the fact that DIPs causing the jam may require reprocessing. A new tube is then placed in the lower head assembly, cycled again to position a tube for a receiving position and the system is reactivated for normal operation.

The various sensors shown in the illustrated embodiment of the invention comprise light emitters and receivers which signal and trigger operation of various mechanisms in the manner described above. It is noted, however, that other types of sensors may be employed. The designations, therefore, S-1 and the like, designate the entire sensor including the light emitter and receiver.

While a particular embodiment of the invention has been illustrated and described herein, it is not intended to limit the invention and changes and modifications may be made therein within the scope of the following claims.

What is claimed is:

1. In a system for handling dual-in-line devices packaged in elongated tubes having releasable closure means normally closing at least one end of the tubes to retain dual-in-line devices therein, a head assembly for transferring tubes from an accumulator station to a dual-in-line processing apparatus comprising a housing having an inlet and a discharge trackway section, a pair of drive rollers rotatably mounted adjacent the inlet end of the housing, said rollers being mounted for floating movement relative to one another in a direction generally transverse to the movement of tubes through the housing, closure removal and re-application mechanism mounted in the housing downstream of said drive rollers, means in the housing for aligning the tube to ensure flow of dual-in-line devices from the tube to the discharge trackway and tube position sensor means operable to activate a mechanism associated with the housing for positioning the head assembly so that the discharge trackway section aligns with an inlet trackway of dual-in-line processing apparatus.

2. In a system as claimed in claim 1, wherein the center of rotation of the upper roller is staggered relative to the center of the lower roller and disposed forwardly thereof toward the discharge trackway to drive the tube forwardly and downwardly and ensure good tracking through the head assembly.

3. A system as claimed in claim 1 wherein the closure removal and reapplication mechanism a cam element mounted adjacent the inlet end of the housing downstream of the drive rollers in the path of a pin at the terminal end of the tube and operable to displace the pin upwardly so that it engages in an elongated channel of a pin-pulling mechanism movably mounted in the housing and means for selectively actuating the pin pulling mechanism in a direction transverse to the path of movement of tubes through the head assembly to thereby effect removal and reapplication of pins in the tube ends.

4. A system as claimed in claim 1 including an adjustable singulating wheel mounted in the housing overlying the discharge trackway and operable to engage dual-in-line package devices discharged from a tube positioned in the head assembly and effect proper spacing thereof during movement along said discharge trackway.

5. A system as claimed in claim 1 wherein the closure removal and reapplication mechanism comprises a plug assembly and disk assembly mechanism mounted in the head assembly including a plug clamping plate and a plug clamp having cooperable interengaging faces for engaging a tab of a plug and actuating means for selectively positioning said plug clamp between clamped and unclamped positions.

6. In a system as claimed in claim 1 including a linkage adjacent the discharge trackway section having a duckbill head portion which engages in the channel of a tube to align the tube properly with respect to the discharge trackway and operable upon pivotal movement in a position wherein the discharge trackway is aligned with a trackway of a dual in-line package processing apparatus.

7. In a system for handling dual in-line package devices packaged in elongated tubes having releasable closure means normally closing at least one end of the tubes to retain dual in-line package devices therein, a head assembly for transferring tubes from an accumulator station to a dual in-line package processing apparatus comprising a housing having an inlet and a discharge trackway section, a pair of drive rollers rotatably mounted adjacent the inlet end of the housing, said rollers being mounted for floating movement relative to one another in a direction generally transverse to the movement of tubes through the housing, closure removal and re-application mechanism mounted in the housing downstream of said drive rollers, and means in the housing for aligning the tube to ensure flow of dual in-line package devices from the tube to the discharge trackway and tube position sensor means operable to activate a mechanism associated with the housing for positioning the head assembly so that the discharge trackway section aligns with an inlet trackway of dual in-line package processing apparatus.

8. A head assembly as claimed in claim 7 including position sensing means for the head assembly located at the discharge end of the housing which senses the attitude of the head assembly and ensures against operation of a singulating roller to discharge dual in-line devices from the tube down the discharge trackway to a processing apparatus aligned with the head assembly.

9. A head assembly for transferring tubes for electronic devices having releasable closure means at least at one end of the tube from an accumulator station to a dual in-line package processing apparatus comprising a housing having an inlet and a discharge trackway section, a pair of drive rollers rotatably mounted adjacent the inlet end of the housing, said rollers being mounted for floating movement relative to one another in a direction generally transverse to the movement of tubes through the housing, closure removal and reapplication mechanism mounted in the housing downstream of said drive rollers, and means in the housing for aligning the tube to ensure flow of dual in-line package devices from the tube to the discharge trackway.

10. A head assembly as claimed in claim 9, wherein said closure is a pin and wherein said pin removal and reapplication mechanism includes an adjustable cam member mounted in the entrance trackway engageable by a closure pin in the forward end of the tube as the tube enters the head assembly housing and a bifurcated trackway disposed above the cam and a pressure plate overlying the trackway to engage the head of the pin and to frictionally engage the head of the pin to retain the pin in a predetermined position in the bifurcated trackway.

11. A head assembly as claimed in claim 10 including a sensor engageable by the forward end of the tube which is operatively connected to the pin removal and reapplication mechanism to retract the pin and maintain it in a predetermined position above the tube, and control means operable when an empty tube is again located in said predetermined position to actuate said pin removal and reapplication mechanism to reinsert the pin in the end of the tube.

12. A head assembly as claimed in claim 11, wherein said sensor comprises an elongated pivotally mounted duckbill linkage.

13. A head assembly as claimed in claim 10, wherein said means for securing the pin in a predetermined position in the trackway includes a spring biased pressure plate frictionally engaging the top of the pin which presses it against the trackway.

14. A head assembly as claimed in claim 9 including means for centering the tube in the inlet trackway of said head assembly.

15. A head assembly as claimed in claim 9 including a pair of side curtains adjacent the entrance end of the housing spaced apart a predetermined distance to allow only tubes of a certain width dimension to enter the head assembly.

16. A head assembly as claimed in claim 9 including adjustable means in the housing for determining the lower limit position for the pin removal and reapplication mechanism.

17. A head assembly as claimed in claim 16, wherein said adjustable means comprises an elongated screw member engaging through the bottom of the housing and acting as a limit stop for the pin removal and reapplication mechanism.

18. A head assembly as claimed in claim 9, wherein said removal and reapplication mechanism is adapted for removing a plug engageable in the end of the tube having a gripping tab which projects downwardly and wherein said removal and reapplication mechanism comprises a fixed jaw and a pivotally mounted complementary jaw member which normally is in an open position and which automatically is pivoted to a closed position when the mechanism is actuated to remove a plug.

19. A head assembly as claimed in claim 18, wherein said means for pivoting said movable jaw to a closed or locked position comprises a rack and pinion actuator.

20. A head assembly as claimed in claim 18 including sensing means associated with said plug pulling mechanism operable to reverse the drive rollers to retract the tube when the plug is engaged by the jaw mechanisms.

* * * * *